US007304466B1

(12) United States Patent
Kimura

(10) Patent No.: US 7,304,466 B1
(45) Date of Patent: Dec. 4, 2007

(54) VOLTAGE REFERENCE CIRCUIT COMPENSATED FOR NON-LINEARITY IN TEMPERATURE CHARACTERISTIC OF DIODE

(75) Inventor: Katsuji Kimura, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 0 days.

(21) Appl. No.: 11/657,490

(22) Filed: Jan. 25, 2007

(30) Foreign Application Priority Data

Jan. 30, 2006 (JP) ..... 2006-020994

(51) Int. Cl.
*G05F 3/16* (2006.01)

(52) U.S. Cl. ..... 323/313; 323/315; 323/316

(58) Field of Classification Search ..... 323/312, 323/313, 314, 315, 316; 327/536, 541
See application file for complete search history.

(56) References Cited

U.S. PATENT DOCUMENTS

| | | | | |
|---|---|---|---|---|
| 5,604,427 | A | 2/1997 | Kimura | |
| 5,625,281 | A * | 4/1997 | Lambert | 323/315 |
| 5,977,759 | A * | 11/1999 | Sitch | 323/315 |
| 6,160,391 | A | 12/2000 | Banba | |
| 6,407,619 | B1 * | 6/2002 | Tanaka | 327/536 |
| 6,452,437 | B1 * | 9/2002 | Takeuchi et al. | 327/513 |
| 6,903,601 | B1 * | 6/2005 | Aude | 327/541 |
| 2005/0194957 | A1 | 9/2005 | Brokaw | |
| 2005/0264345 | A1 | 12/2005 | Ker et al. | |

FOREIGN PATENT DOCUMENTS

| | | |
|---|---|---|
| JP | 8-123568 | 5/1996 |
| JP | 11-45125 | 2/1999 |

(Continued)

OTHER PUBLICATIONS

"New Curvature-Compensation Tehnique for CMOS Bandgap Reference with Sub-1-V Operation" Ming-Dou Ker, et al. Nanoelectronics & Gigascale Sytems Laboratory, Institute of Electronics, National Chiao-Tung University, Hsinchu, Taiwan, IEEE 2005.

(Continued)

*Primary Examiner*—Adolf Berhane
(74) *Attorney, Agent, or Firm*—McGinn IP Law Group, PLLC

(57) ABSTRACT

Disclosed is a reference voltage generating circuit comprising a first reference current circuit including first and second current-to-voltage converting circuits, control means for exercising control in such a manner that prescribed output voltages of the first and second current-to-voltage converting circuits become equal, and a first current mirror circuit for supplying currents to respective ones of the first and second current-to-voltage converting circuits; a second reference current circuit having third and fourth current-to-voltage converting circuits, control means for exercising control in such a manner that prescribed output voltages of the third and fourth current-to-voltage converting circuits become equal, and a second current mirror circuit which has a linear input/output characteristic, for supplying currents to respective ones of the third and fourth current-to-voltage converting circuits; and means for outputting a difference current between output current of the first reference current circuit and output current of the second reference current circuit. An output voltage is obtained from the difference current via a fifth current-to-voltage converting circuit.

20 Claims, 13 Drawing Sheets

FOREIGN PATENT DOCUMENTS

JP 2006-209212 8/2006

OTHER PUBLICATIONS

New Developments in IC Voltage Regulators, Robert J. Widlar, IEEE Jouranl of Solid State Circuits, vol. sc-6, No. 1, Jul. 1970.

"A CMOS Bandgap Reference Circuit with Sub-1-V Operation", Hironori Banada, et al., IEEE Journal of Solid-State Circuits, vol. 34, No. 5, May 1999.

* cited by examiner

VOLTAGE REFERENCE CIRCUIT COMPENSATED FOR NON-LINEARITY IN TEMPERATURE CHARACTERISTIC OF DIODE

FIELD OF THE INVENTION

This invention relates to a CMOS voltage reference circuit and, more particularly, to a CMOS voltage reference circuit formed on a semiconductor integrated circuit, the CMOS voltage reference circuit having a small chip area, operating from low voltage and being compensated for non-linearity in temperature characteristic of diode.

BACKGROUND OF THE INVENTION

Such voltage reference circuits compensated for non-linearity in temperature characteristic of diode have appeared from time to time but until recently there have been no proposals capable of convincing experts in this field. Now, however, proposals capable of persuading such experts are being made.

A first of such proposals is that by Brokaw, an elder in the field. A second is by the present inventor (Kimura), who holds the largest number of registered patents in the field. The characterizing feature of the first and second proposed circuits is that both utilize a circuit network, which comprises diodes and resistors, as a circuit block that is capable of compensating for the non-linearity in non-linearity in temperature characteristic of diode. A third proposal is a circuit developed by Ker et al. from National Chiao-Tung University in Taiwan.

The Brokaw circuit, which is the first proposed circuit mentioned above, will be described first with reference to FIG. 6. In the specification of Patent Document 1 (US2005/0194957A1), many equations are set forth and temperature characteristics are described. Here we will limit our discussion to what is illustrated in FIG. 6.

In FIG. 6, let the forward voltages of diodes D1 and D2 be represented by VBE1 and VBE2, respectively. An error-voltage amplifying circuit AP1 operates so as to control the gate voltage of p-channel MOS transistors M1 and M2 in such a manner that voltages VA and VB at differential input terminals of the error-voltage amplifying circuit AP1 will be equal.

Accordingly, we have the following:

$$VA=VB=VBE1 \quad (1)$$

If we assume that V1 is the voltage at a common connection node of resistors R1, R2 and R3, then a current IR1 that flows into resistor R1 is given by Equation (2) below.

$$IR1=(VBE1-V1)/R1=\Delta V1/R1 \quad (2)$$

Further, a current IR2 that flows into resistor R2 is given by Equation (3) below.

$$IR2=(V1-VBE2)/R2=\Delta V2/R2 \quad (3)$$

A current IR3 that flows into resistor R3 is given by Equation (4) below.

$$IR3=V1/R3 \quad (4)$$

Equation (5) below holds with regard to current.

$$IR1=IR2+IR3 \quad (5)$$

The relation indicated by Equation (6) below holds in view of Equation (5) and Equations (2) to (4).

$$\Delta V1/R1=\Delta V2/R2+V1/R3 \quad (6)$$

If temperature characteristics are taken into consideration, the forward voltage VBE1 of diode D1 will have a negative temperature characteristic (the value of the temperature coefficient is negative), as is well known. Moreover, the lower the temperature, the smaller the slope of this temperature characteristic becomes. This is a cause of problematic non-linearity.

If it is assumed for the sake of simplicity that resistors R1, R2, and R3 (, R4) have no temperature characteristic, then a current I3 supplied from a transistor M3 will be proportional to a current I2 supplied from transistor M2 and is given by the following:

$$I2=IR1(=\Delta V1/R1) \quad (7)$$

Owing to the fact that VREF (=I3R4) does not possess a temperature characteristic, voltage V1 at the common connection terminal of resistors R1, R2 and R3 becomes a voltage smaller by a constant voltage value than the forward voltage VBE1 of diode D1. If illustrated, the voltage will be a curve obtained by a downward parallel translation of VBE1.

On the other hand, in view of Equation (6), the forward voltage VBE2 of diode D2 comes to possess an even greater negative temperature characteristic so as to cancel out the negative temperature characteristic of V1. That is, it will be understood that the temperature characteristic cannot be cancelled out unless the voltages become voltages having temperature characteristics of the kind shown in FIG. 7.

FIG. 8 illustrates SPICE simulation values (the temperature characteristic of an output voltage Vref) of the circuit (see FIG. 6) according to Brokaw. As depicted in FIG. 8, a temperature deviation of ±0.15% is obtained over a 190° C. temperature range of −55° C. to 135° C.

Next, the circuit according to Kimura (Japanese Patent Application No. 2005-016902 (Japanese Patent Kokai Publication No. JP-P2006-209212A)), will be described. As shown in FIG. 9, the forward voltages of diodes D1 and D2 are represented by VBE1 and VBE2, respectively. An error-voltage amplifying circuit (differential amplifying circuit or operational amplifier) AP1 operates so as to control the gate voltages of transistors M1 and M2 in such a manner that voltages VA and VB at differential input terminals of the error-voltage amplifying circuit AP1 will be equal.

Accordingly, we have the following:

$$VA=VB=V1 \quad (8)$$

Here, a current IR1 that flows into a resistor R1 and a current IR3 that flows into a resistor R3 are represented by Equations (9) and (10), respectively, below.

$$IR1=(V1-VBE1)/R1=\Delta V1/R1 \quad (9)$$

$$IR3=(V1-VBE2)/R3=\Delta V2/R1 \quad (10)$$

If it is assumed for the sake of simplicity that resistors R1, R2, R3 and R4 (, R5) have no temperature characteristic and that the IR1 and IR3 have no temperature characteristic, then the following will hold in case of IR1=IR3:

$$\Delta V1/R1=\times V2/R3 \quad (11)$$

Accordingly, since both sides of Equation (11) possess no temperature characteristic, both VBE1 and VBE2 become voltages smaller by constant voltage values than V1. If illustrated, the voltages will be curves respectively obtained by downward parallel translations of V1.

That it, it will be understood that the temperature characteristic cannot be cancelled out unless the voltages become voltages having temperature characteristics of the kind shown in FIG. 10.

The SPICE simulation values of this circuit are illustrated in FIG. 11. This is for a case where, when the power-supply voltage is 1.2 V, R1=1.2 KΩ, R2=70 KΩ, R3=2.408 KΩ, R4=38 KΩ and R5=20 KΩ hold, two diodes D1 and D2 are connected in parallel (X2) as unit diodes, the transistors M1, M2 and M3 are made equal and the current mirror ratio is made 1:1:1. The voltage obtained will be 542.5 mV at −46° C., 541.2 mV at 27° C. and 542.4 mV at 100° C., and the temperature characteristic is +0.185% over a temperature range of 140° C. The minimum voltage is at ordinary temperature (27° C.) and the voltage rises minutely at low (−46° C.) and high temperatures. Hence the temperature characteristic obtained has a very slight bowl-shaped appearance.

Although an inverted bowl shape was initially obtained in the SPICE simulation, the temperature characteristic could be linearized by changing the value of resistor R3. It so happened that in the case of the values cited above, the curve somewhat exceeded a straight line and the bowl-shaped temperature characteristic resulted.

The circuit according to Ker et al. will be described next. The circuit according to Ker et al. (see FIG. 3 of Non-Patent Document 1) illustrated in FIG. 12 is described as using two Banba circuits, one of p-channel (p-ch) and one of n-channel (n-ch), in which the difference between the output currents of the two circuits is calculated and the temperature characteristic cancelled. FIG. 13 is a diagram useful in describing the mechanism that is at work [see FIG. 2 of Non-Patent Document 1 and FIG. 7, etc., of Patent Document 2 (US2005/0264345 A1)].

As illustrated in (A) of FIG. 13, a Banba circuit, which includes a diode-connected pnp transistor (band gap reference A with pnp BJTs) and a current mirror circuit composed of n-ch transistors M3 and M4, is adopted as a first reference current circuit for output current I1, a Banba circuit, which includes a diode-connected npn transistor (band gap reference B with npn BJTs) and a current mirror circuit composed of p-ch transistors M1 and M2, is adopted as a second reference current circuit for output current I2, and the output current I1 of the first reference current circuit is subtracted from the output current I2 of the second reference current circuit to obtain the following:

$$\Delta I(=I2-I1) \tag{12}$$

As illustrated at (B) and (D) of FIG. 13, the output currents I1 and I2 of the first and second reference current circuits both exhibit bowl-shaped temperature characteristics. However, with an ordinary circuit of this type such as the Banba circuit (Patent Document 3), it is reported that the temperature characteristic becomes a bowl of inverted shape.

In order for the following to hold:

$$I1 \ll I2 \tag{13}$$

with regard to the output currents I1 and I2 of the first and second reference current circuits, it goes without saying that it is necessary to make the number of diodes connected in parallel and resistance values in the first reference current circuit very different from those in the second reference current circuit. However, this does not mean that the characteristics of the pnp transistor and p-ch transistor will coincide with the characteristics of the npn transistor and n-ch transistor, and to what extent cancellation can be achieved is in doubt.

The Banba circuit is illustrated in Patent Document 3 (Japanese Patent Kokai Publication No. JP-A-11-45125) or Patent Document 4 (U.S. Pat. No. 6,160,391).

Reference is usually had to the Banba et al. paper ("A CMOS Band-Gap Reference Circuit with Sub IV Operation," 1998 IEEE Symposium on VLSI Circuits, Digest of Technical Papers 19.3, pp. 228-229, or the full paper in IEEE Journal of Solid-State Circuits, Vol. 34, No. 5, pp. 670-674, May 1999). However, although the way in which input voltages to the error-voltage amplifying circuit are divided respectively by associated resistors R1*a*, R1*b*, R2*a* and R2*b* shown in FIG. 12 (where R1*b*-NPN and R2*b*_NPN have been interchanged) and set to voltage values obtained by the division of diode voltages, is exactly same as that shown in FIG. 6 of the Banba patent specification (FIG. 8 of the U.S. patent), it is not described in the Banba et al. paper mentioned above. For this reason it is often referred to as the work of other publishers of papers from Japanese Patent Kokai Publication No. JP-A-11-45125 onward and, moreover, from publication of the Banba et al. paper onward. This circuit is old and is an application filed on Jul. 29, 1997. The invention precedes that date.

The circuit shown in FIG. 12 (FIG. 3 in Non-Patent Document 1) is an arrangement in which two Banba circuits of different polarities are combined. In the first reference current circuit, if nPNP is assumed to be the area ratio of the two diode-connected pnp transistors (Q1_PNP, Q2_PNP), the current I1 will be represented by Equation (14) below.

$$I1=[VBE2_PNP+(R2_PNP/R3_PNP)VT\ \ln(nPNP)]/R2_PNP \tag{14}$$

In Equation (14), we have the following:

$$R1_PNP=R1a_PNP+R1b_PNP=R2_PNP=R2a_PNP+R2b_PNP \tag{14.1}$$

Further, in Equation (14), VBE2_PNP is a base-emitter voltage of Q2_PNP, and VT is a thermal voltage.

Similarly, in the second reference current circuit, if nNPN is assumed to be the area ratio of the two diode-connected npn transistors (Q1_NPN, Q2_NPN), the current I2 will be represented by Equation (15) below.

$$I2=[VBE2_NPN+(R2_NPN/R3_NPN)VT\ \ln(nNPN)]/R2_NPN \tag{15}$$

In Equation (15), we have the following:

$$R1_NPN=R1a_NPN+R2b_NPN=R2_NPN=R2a_NPN+R1b_NPN \tag{15.1}$$

Further, in Equation (15), VBE2_NPN is a base-emitter voltage of Q2_NPN, and VT is a thermal voltage.

It should be noted that what is correct in Equation (15.1) is R1_NPN=R1*a*_NPN+R1*b*_NPN=R2_NPN=R2*a*_NPN+R2*b*_PNP.

If the error in writing is corrected, Equations (14) and (15) will be the same and the PNP side and NPN side will be the same.

The expression in the bracket in Equation (14) or (15), namely [VBE2_PNP+(R2_PNP/R3_PNP)VT ln(nPNP)], or [VBE2_NPN+(R2_NPN/R3_NPN)VT ln (nNPN)] is an expression illustrated in a circuit analysis formula of a reference voltage generating circuit of this kind, namely a reference voltage generating circuit that is known as the invention of Dobkin et al. (U.S. Pat. No. 3,617,859), the so-called "Widlar bandgap voltage reference" named after one of the co-patentees.

That this reference voltage generating circuit is named not after the head (first) inventor but after the co-inventor (second inventor) also is odd. The reason is a paper authored solely by the co-inventor (second inventor) (R. J. Widlar, "New Developments in IC Voltage Regulators," IEEE Journal of Solid-State Circuits, Vol. SC-6, No. 1, pp. 2-6, February 1971). In actuality, however, the circuit analysis formula of the U.S. Patent and technical paper is not a relational expression between Q1(VBE1) and Q2 (VBE2) directly related to a reference voltage generating voltage, but is a relational expression between Q3(VBE3) that controls Q1 and Q2 and Q2 (VBE2) directly related to a reference voltage generating voltage, wherein the expression is written using VBE1 instead of VBE3. Specialists in this field find this difficult to understand.

A self-bias method was subsequently used in reference voltage generating circuits of this kind and the fact that equal currents are passed through the transistors Q1 and Q2 became readily understandable in terms of circuit operation.

In a reference voltage generating circuit of this kind, the reference voltage that is output is indicated by an equation in which either of the VBE voltages and the difference voltage (ΔVBE) between the two VBE voltages are weighted and added. That is, the expressions within the brackets of Equations (14) and (15) correspond to this equation.

In Equation (14), we have the following:

$$\Delta VBE = VT \ln(nPNP) \tag{16}$$

In Equation (15), we have the following:

$$\Delta VBE = VT \ln(nNPN) \tag{17}$$

As is well known, ΔVBE has a positive temperature characteristic, and VBE has a negative temperature characteristic (temperature coefficient) of about −1.9 mV/° C. Accordingly, the temperature characteristic can be cancelled out by weighting and adding ΔVBE and VBE. VT is 26 mV at ambient temperature (i.e., at about 300 K (absolute temperature)), while VBE is assumed to be 600 mV at ambient temperature. More specifically, the temperature characteristic of the expression: ΔVBE+(R2/R3)VT ln(n), which corresponds to the one within the brackets of Equations (14) and (15), is able to be compensated, when the value of the weighted sum of −1.9 mV and (26 mV/300) become zero. The weighting therefore is set to:

$$21.9[=1.9\ \text{mV}/(26\ \text{mV}/300)] \tag{18}$$

Since the weighting corresponds to (R2/R3)ln(n), we have the following:

$$(R2/R3)\ln(n) = 21.9 \tag{19}$$

This 21.9 is distributed to the resistor ratio (R2/R3) and to the logarithmic value ln(n) of the emitter area ratio n.

This is correct as a primary approximation. However, when the secondary effects of the negative temperature characteristic of VBE are considered, the output voltage of the reference voltage generating circuit generally becomes an inverted bowl-shaped characteristic in which voltage is not cancelled out completely but declines regardless of whether temperature rises or falls from ordinary temperature.

In the circuit according to Ker et al., I1 [Equation (14)] is subtracted from I2 [Equation (15)]. However, since a difference appears, naturally it is necessary to set I1 and I2 so that I2>I1 will hold.

In Equations (14) and (15), however, R2 is a resistor that converts the reference voltage to a current, although originally this is a resistor for weighted addition for the purpose of compensating for the temperature characteristic of the reference voltage. Accordingly, in order to set the output currents to I2>I1, naturally it is necessary to make the emitter area ratio n very different between the NPN and PNP sides.

More specifically, the following holds:

$$R2_NPN < R2_PNP \tag{20}$$

Therefore, if we assume the following for the sake of simplicity:

$$R3_NPN = R3_PNP \tag{21}$$

then it is necessary to set nNPN and n-PNP as follows:

$$nNPN >> nPNP \tag{22}$$

Further, that NPN and PNP, which are of different polarities, will have characteristics that coincide is inconceivable.

It should be noted that although a reference current circuit so adapted as to not possess a temperature characteristic by combining a PTAT (proportional to absolute temperature) and an inverse PTAT circuit is disclosed in FIG. 4 of Patent Document 5 by the present inventor, it should be added that compensation for non-linearity (non-linearity in the temperature characteristic) of a diode is not carried out.

[Patent Document 1] US Patent Specification US 2005/0194957 A1

[Patent Document 2] US Patent Specification US 2005/0264345 A1

[Patent Document 3] Japanese Patent Kokai Publication No. JP-A-11-45125

[Patent Document 4] US Patent Specification U.S. Pat. No. 6,160,391

[Patent Document 5] Japanese Patent Kokai Publication No. JP-A-8-123568

[Non-Patent Document 1] M.-D. Ker et al., "New Curvature-Compensation Technique for CMOS Bandgap Reference with Sub-1-V Operation," (IEEE ISCAS' 05), Publication Date 23-26, May 2005 FIG. 3

The voltage reference circuits described above with reference to FIGS. 6, 12 and 13 have the problems set forth below.

The first problem is a large variation. The reason for this is characteristics do not coincide because use is made of diode-connected NPN and PNP transistors the polarities of which differ.

The second problem is that it is difficult to achieve a high precision. The reason for this is that it is attempted to perform cancellation by reference current circuits having temperature characteristics of small non-linearity. This makes it difficult to obtain a high precision.

SUMMARY OF THE DISCLOSURE

Accordingly, in view of the problems set forth above, the present invention seeks to implement a voltage reference circuit that operates from low voltage and outputs any desired reference voltage in which non-linearity of a temperature characteristic is cancelled out with high precision.

The present invention provides a voltage reference circuit comprising a first reference current circuit, a second reference current circuit and means for outputting a difference current between output current of the first reference current circuit and output current of the second reference current circuit. The first reference current circuit includes first and second current-to-voltage converting circuits; first control means for exercising control in such a manner that a prescribed output voltage of the first current-to-voltage converting circuit and a prescribed output voltage of the second current-to-voltage converting circuit will be equal to each other; and a first current mirror circuit for supplying currents to respective ones of the first and second current-to-voltage converting circuits; and the second reference current circuit includes: third and fourth current-to-voltage converting circuits; second control means for exercising control in such a manner that a prescribed output voltage of the third current-to-voltage converting circuit and a prescribed output voltage of the fourth current-to-voltage converting circuit will be equal to each other; and a second current mirror circuit for supplying currents to respective ones of the third and fourth current-to-voltage converting circuits. The present invention obtains an output voltage from the difference current between the output current of the first reference current circuit and the output current of the second reference current circuit via a fifth current-to-voltage converting circuit.

In the present invention, it is preferred that the first and second current mirror circuits be linear current mirror circuits having a linear input/output characteristic.

In the present invention, means for outputting the difference current between the output currents of the two reference current circuits is adapted so as to inject currents, which are proportional to output currents of the first current mirror circuit, into respective ones of the third and fourth current-to-voltage converting circuits, wherein it is so arranged that output voltage is obtained via the fifth current-to-voltage converting circuit that receives the output current of the second current mirror circuit.

In the present invention, each of the first and third current-to-voltage converting circuits comprises a diode; the second current-to-voltage converting circuit includes a series circuit, which comprises one diode or a plurality of parallel-connected diodes and a first resistor connected in series with the one diode or plurality of diodes, and a second resistor connected in parallel with the series circuit; the fourth current-to-voltage converting circuit includes a series circuit, which comprises one diode or a plurality of parallel-connected diodes and a third resistor connected in series with the one diode or plurality of diodes, and a fourth resistor connected in parallel with the series circuit; and the fifth current-to-voltage converting circuit comprises a fifth resistor.

In the present invention, the first control means comprises a first differential amplifying circuit, to which the prescribed output voltage of the first current-to-voltage converting circuit and the prescribed output voltage of the second current-to-voltage converting circuit are differentially input, for delivering an output voltage that controls a common node of the first current mirror circuit; and the second control means comprises a second differential amplifying circuit, to which the prescribed output voltage of the third current-to-voltage converting circuit and the prescribed output voltage of the fourth current-to-voltage converting circuit are input, for delivering an output voltage that controls a common node of the second current mirror circuit.

In the present invention, the first reference current circuit and the second reference current circuit have numbers of diodes that different from each other and different non-linearities of temperature characteristics of the diodes.

In the present invention, diodes (or diode-connected bipolar transistors) and resistors can be connected in series and the resistors can further be connected in parallel, thereby causing the non-linearity of the temperature characteristics of the diodes (or diode-connected bipolar transistors) to be more pronounced. This makes it possible to achieve cancellation between the two circuits with a high degree of precision.

The meritorious effects of the present invention are summarized as follows.

In accordance with the present invention, temperature characteristics can be diminished. The reason for this in that in the present invention, cancellation is performed between two circuits in which non-linearity of diode temperature characteristics appears prominently. In accordance with the present invention, the effects of non-linear temperature characteristics of diodes are mitigated to make possible an increase in precision.

In accordance with the present invention, the circuit can be operated at low voltages. The reason for this is that in the present invention, the output voltage can be set to any voltage value of 1.2 V or less (or more specifically, 1.0 V or less).

In accordance with the present invention, it is possible to achieve a high precision. The reason for this is that in the present invention, the circuit topologies of the two reference current circuits are made the same.

Still other features and advantages of the present invention will become readily apparent to those skilled in this art from the following detailed description in conjunction with the accompanying drawings wherein embodiments of the invention are shown and described, simply by way of illustration of the mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

DESCRIPTION OF THE INVENTION

The present invention will now be described in detail with reference to the drawings.

Figure 1:
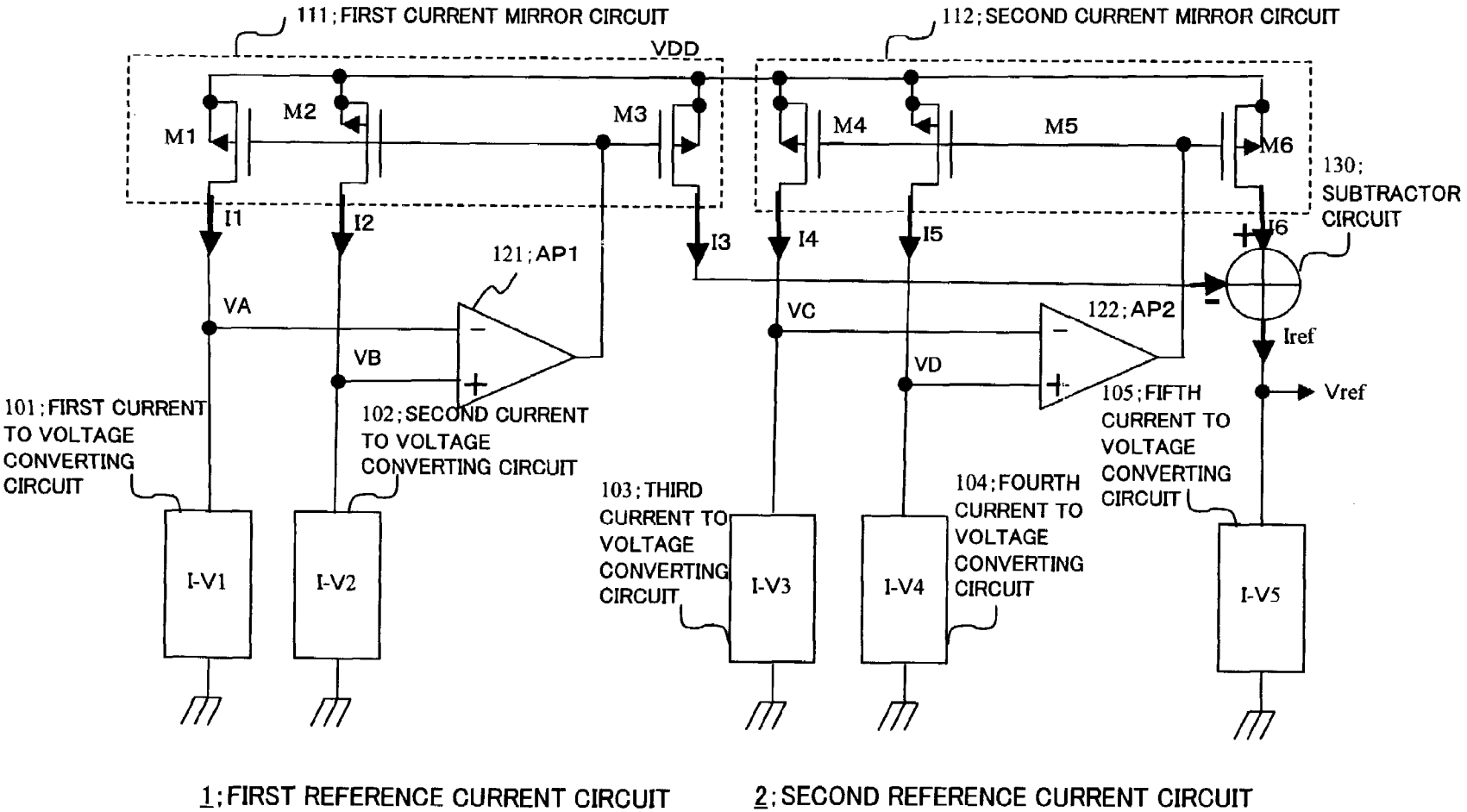
FIG. 1 is a diagram illustrating a circuit configuration embodying the present invention.

As shown in FIG. 1, the present invention comprises a first reference current circuit 1 and a second reference current circuit 2. The first reference current circuit (1) includes: first and second current-to-voltage converting circuits (101 and 102); control means (121) for exercising control in such a manner that prescribed output voltages (respective voltages at nodes VA and VB) of the first and second current-to-voltage converting circuits (101 and 102) will be equal; and a first current mirror circuit (111) for supplying currents (I1 and I2) to the first and second current-to-voltage converting circuits (101 and 102), respectively.

The second reference current circuit (2) includes: third and fourth current-to-voltage converting circuits (103 and 104); control means (122) for exercising control in such a manner that prescribed output voltages (respective voltages at nodes VC and VD) of the third and fourth current-to-voltage converting circuits (103 and 104) will be equal; and a second current mirror circuit (112) for supplying currents (14 and 15) to the third and fourth current-to-voltage converting circuits (103 and 104), respectively. From the first current mirror circuit (111) is taken out the output current (13) of the first reference current circuit (1), while from the second current mirror circuit (112) is taken out the output current (16) of the second reference current circuit (2).

There are provided means (130) for outputting a difference current (Iref) between an output current (13) of the first reference current circuit (1) and an output current (16) of the second reference current circuit (2); and a fifth current-to-voltage converting circuit (105) for obtaining a reference voltage (Vref) from the difference current (Iref).

More specifically, in the present invention, the first reference current circuit (1) includes first and second current-to-voltage converting circuits (101 and 102); first to third transistors (M1, M2 and M3) having sources (first terminals) connected in common to a power supply (VDD) and gates (control terminals) coupled together; and a first differential amplifying circuit (121) having an inverting input terminal (−) and a non-inverting input terminal (+) connected respectively to the connection node of a terminal of the first current-to-voltage converting circuit (101) and a drain (second terminal) of the first transistor (M1), and to the connection node of a terminal of the second current-to-voltage converting circuit (102) and a drain of the second transistor (M2) and having an output terminal connected to the commonly coupled gates of the first to third transistors (M1, M2 and M3).

The second reference circuit (2) includes third and fourth current-to-voltage converting circuits (103 and 104); fourth to sixth transistors (M4, M5 and M6) having sources connected in common to a power supply (VDD) and gates (control terminals) coupled together; and a second differential amplifying circuit (122) having an inverting input terminal (−) and a non-inverting input terminal (+) connected respectively to the connection node of a terminal of the third current-to-voltage converting circuit (103) and a drain of the fourth transistor (M4), and to the connection node of a terminal of the fourth current-to-voltage converting circuit (104) and a drain of the fifth transistor (M5) and having an output terminal connected to the commonly coupled gates of the fourth to sixth transistors (M4, M5 and M6).

There are provided a subtractor circuit (130) for obtaining a difference current (Iref) between an output current (I3) from a drain of the third transistor (M3) and an output current (I6) from a drain of the sixth transistor (M6); and a fifth current-to-voltage converting circuit (105) for converting the difference current (Iref) from the subtractor circuit (130) to a voltage for being taken out as an output voltage (Vref).

The first and third current-to-voltage converting circuits (101 and 103) each comprises a diode (D1) having a cathode terminal grounded and an anode connected to the terminal of each of the first and third current-to-voltage converting circuits (101 and 103).

The second and fourth current-to-voltage converting circuits (102 and 104) each comprises a series circuit including one diode with its cathode terminal grounded or a plurality of parallel-connected diodes with their cathode terminals grounded and a resistor, and a separate resistor connected in parallel with the series circuit. The resistor and the separate resistor are connected in common to the terminal of each of the second and fourth current-to-voltage converting circuits (102 and 104).

The fifth current-to-voltage converting circuit (105) comprises a resistor having one end connected to ground and its other end connected to the subtractor circuit (130).

In the second and fourth current-to-voltage converting circuits (102 and 104) according to the present invention, it may be so arranged that the respective circuit topologies, such as the numbers of diodes, and/or element values are made to differ from each other.

Figure 3:
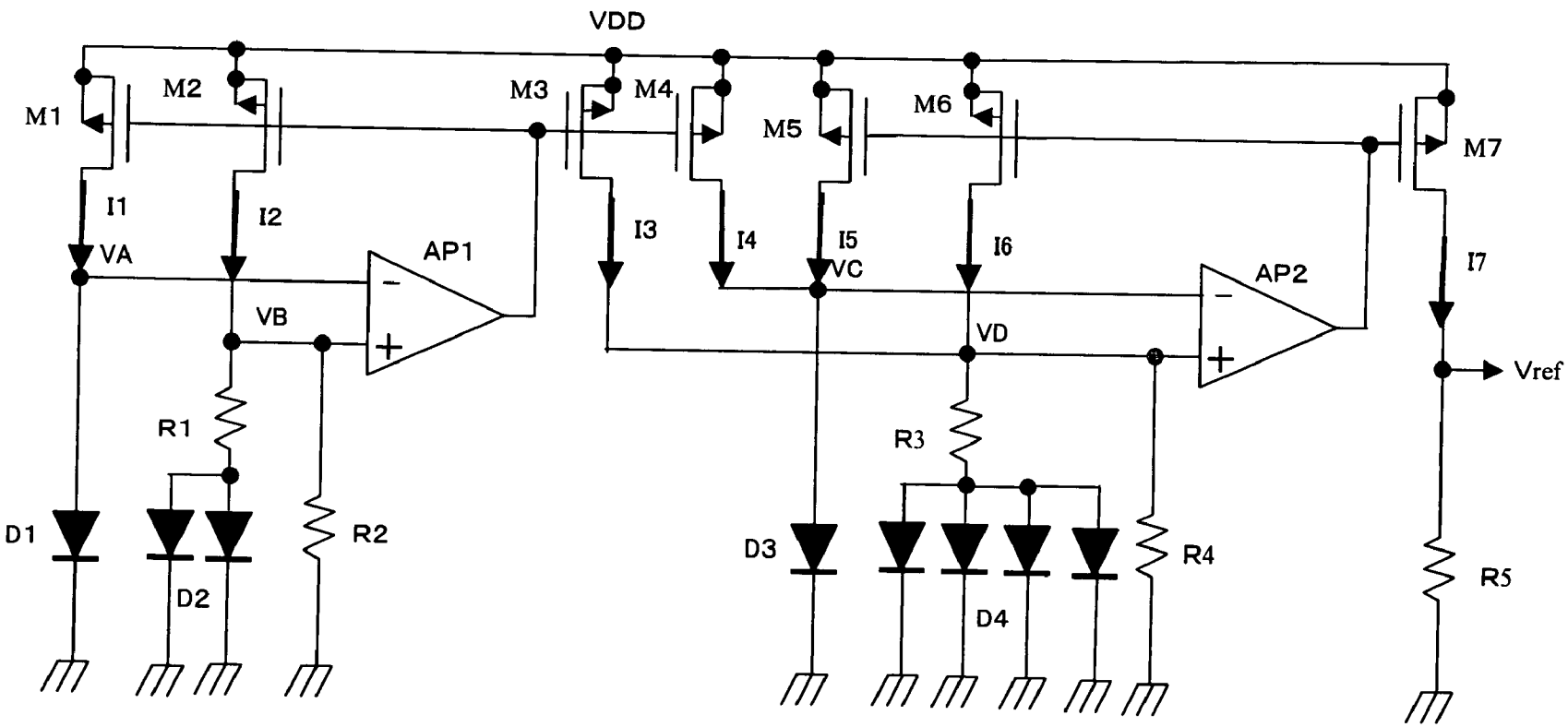
FIG. 3 is a diagram illustrating a circuit configuration according to a first example of the present invention.

Alternatively, as shown in FIG. 3, the first reference current circuit includes: a first current-to-voltage converting circuit comprising a diode (D1); a second current-to-voltage converting circuit including a series circuit composed of a plurality of diodes (D2) connected in parallel, each having one end thereof grounded and a resistor (R1) and a separate resistor (R2) connected in parallel with the series circuit; first to fourth transistors (M1, M2, M3 and M4) having sources (first terminals) connected in common to the power supply (VDD) and gates (control terminals) coupled together and constructing a first current mirror circuit; and a first differential amplifying circuit (AP1) having an inverting input terminal and a non-inverting input terminal respectively connected to a connection node (VA) of a terminal of the first current-to-voltage converting circuit (D1) and a drain (first terminal) of the first transistor (M1) and a connection node (VB) of a terminal of the second current-to-voltage converting circuit (D2, R1 and R2) and a drain of second transistor (M2), and an output terminal connected to the coupled gates of first to fourth transistors (M1, M2, M3 and M4).

The second reference current circuit includes: a third current-to-voltage converting circuit comprising diode (D3); a fourth current-to-voltage converting circuit including a series circuit of parallel-connected diodes (D4) each having one end thereof grounded and resistor (R3), and a separate resistor (R4) connected in parallel with the series circuit; fifth to seventh transistors (M5, M6 and M7) having sources connected in common to the power supply (VDD) and gates coupled together and constructing a second current mirror circuit; and a second differential amplifying circuit (AP2) having an inverting input terminal and a non-inverting input terminal respectively connected to a connection node (VC) of a terminal of the third current-to-voltage converting circuit (D3) and a drain of the fifth transistor (M5) and a connection node (VD) of a terminal of the fourth current-to-voltage converting circuit (D4, R3 and R4) and the sixth transistor (M6), and an output terminal connected to the coupled gates of fifth to seventh transistors (M5, M6 and M7). A drain of the third transistor (M3) is connected to the connection node of fourth current-to-voltage converting circuit (D4, R3 and R4), a drain of the sixth transistor (M6) and a non-inverting input terminal (+) of the second differential amplifying circuit (AP2), and a drain of fourth transistor (M4) is connected to the connection node of a terminal of the third current-to-voltage converting circuit (D3), a drain of the fifth transistor (M5) and an inverting input terminal (−) of second differential amplifying circuit (AP2). Further provided is a fifth current-to-voltage converting circuit, which comprises a resistor (R5) having one end connected to the drain of seventh transistor (M7) and its other end connected to ground, for converting current (I7) of the seventh transistor (M7) to a voltage for being taken out as an output voltage (Vref). In the first and second reference current circuits according to the present invention, the number of diodes in the second current-to-voltage converting circuit differs from the number of diodes in the fourth current-to-voltage converting circuit (i.e., the number of diodes D2 differs from the number of diodes D4), and the non-linearities of the temperature characteristics of these diodes are made to differ, thereby compensating for the temperature characteristic of the output voltage. The resistance value of the resistor R1 in the second current-to-voltage converting circuit and the resistance value of the resistor R3 in the second current-to-voltage converting circuit may be made different values, and the values of the output currents in the first and second reference current circuits may be made different.

Figure 5:
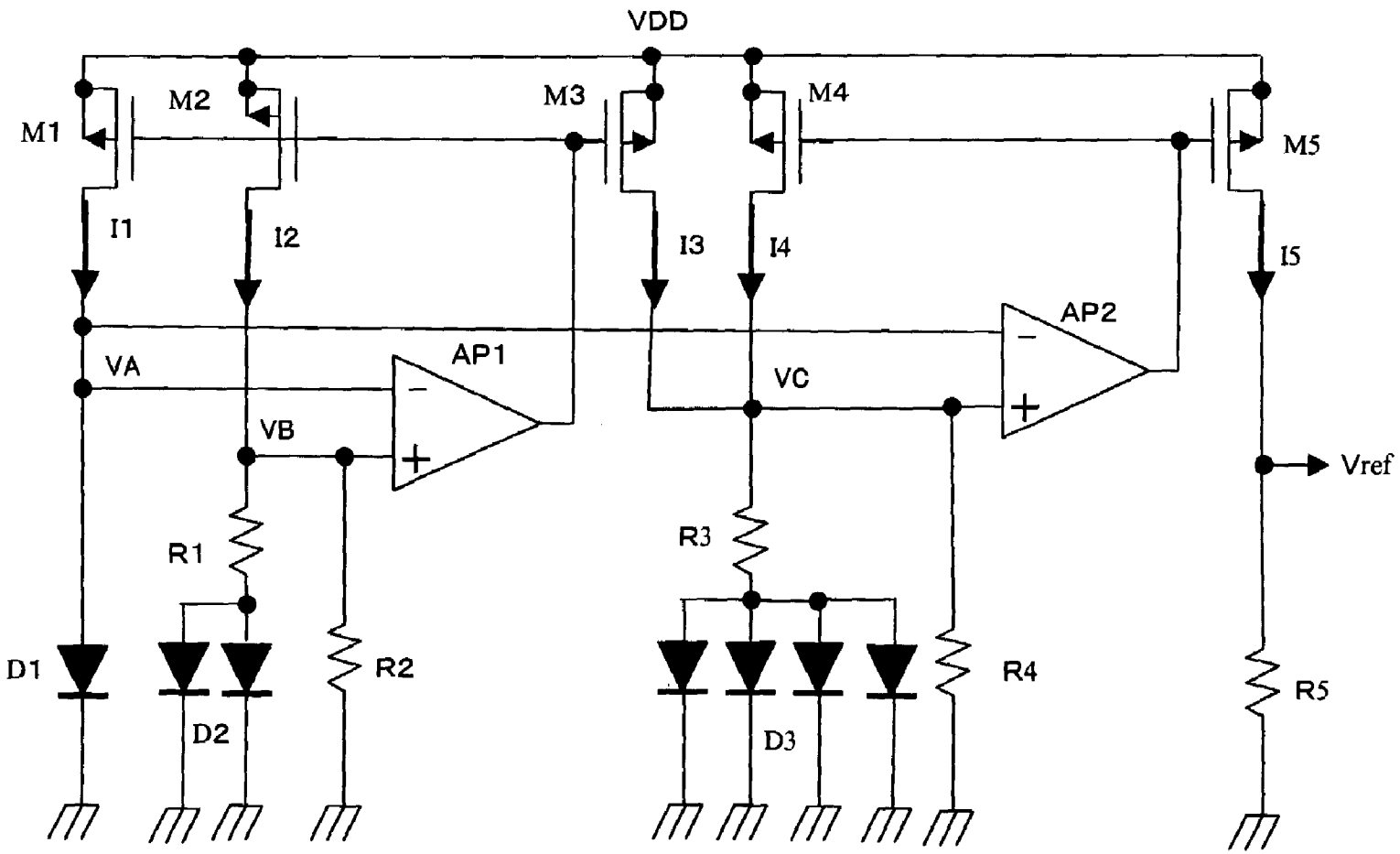
FIG. 5 is a diagram illustrating a circuit configuration according to a second example of the present invention.
Figure 6:
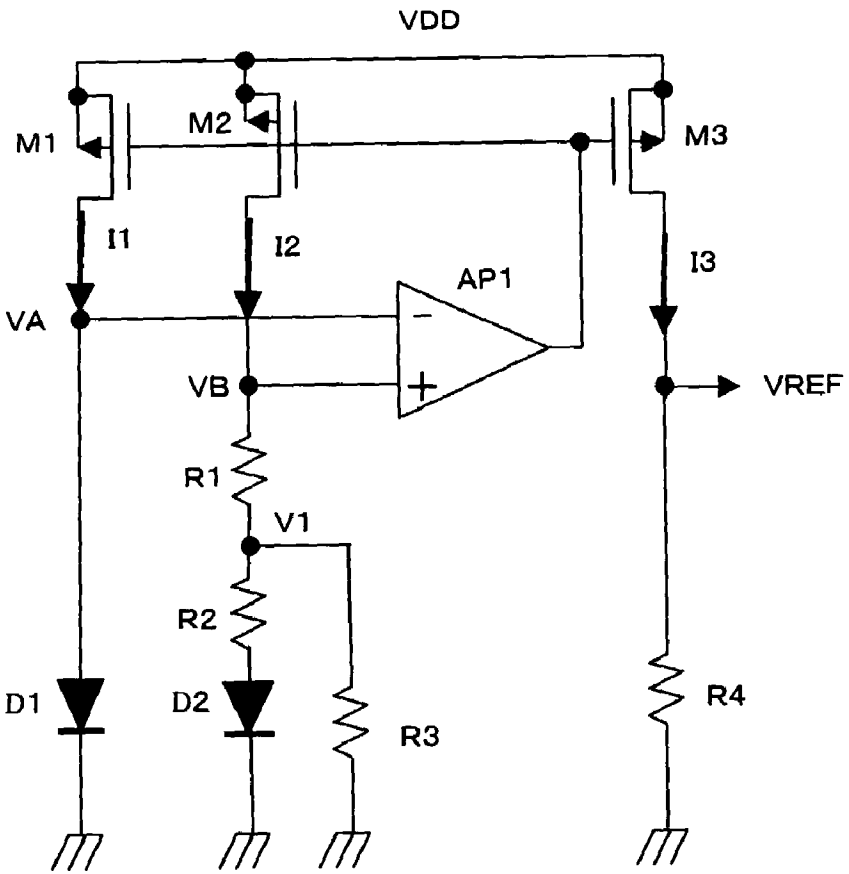
FIG. 6 CONVENTIONAL ART
FIG. 6 is a diagram illustrating the configuration of a conventional voltage reference circuit proposed by Brokaw.
Figure 7:
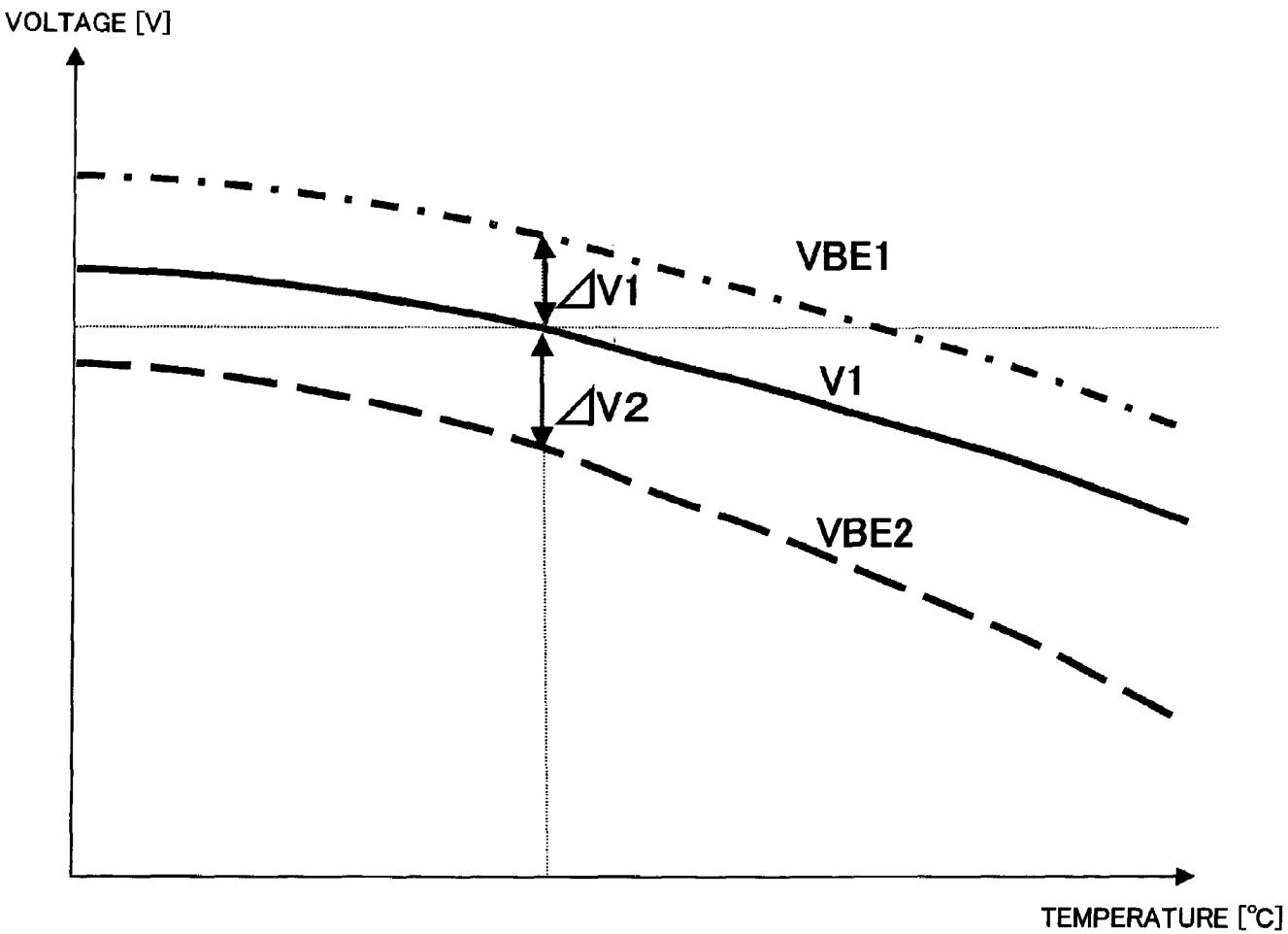
FIG. 7 CONVENTIONAL ART
FIG. 7 is a diagram useful in describing the operation of the conventional voltage reference circuit proposed by Brokaw.
Figure 8:
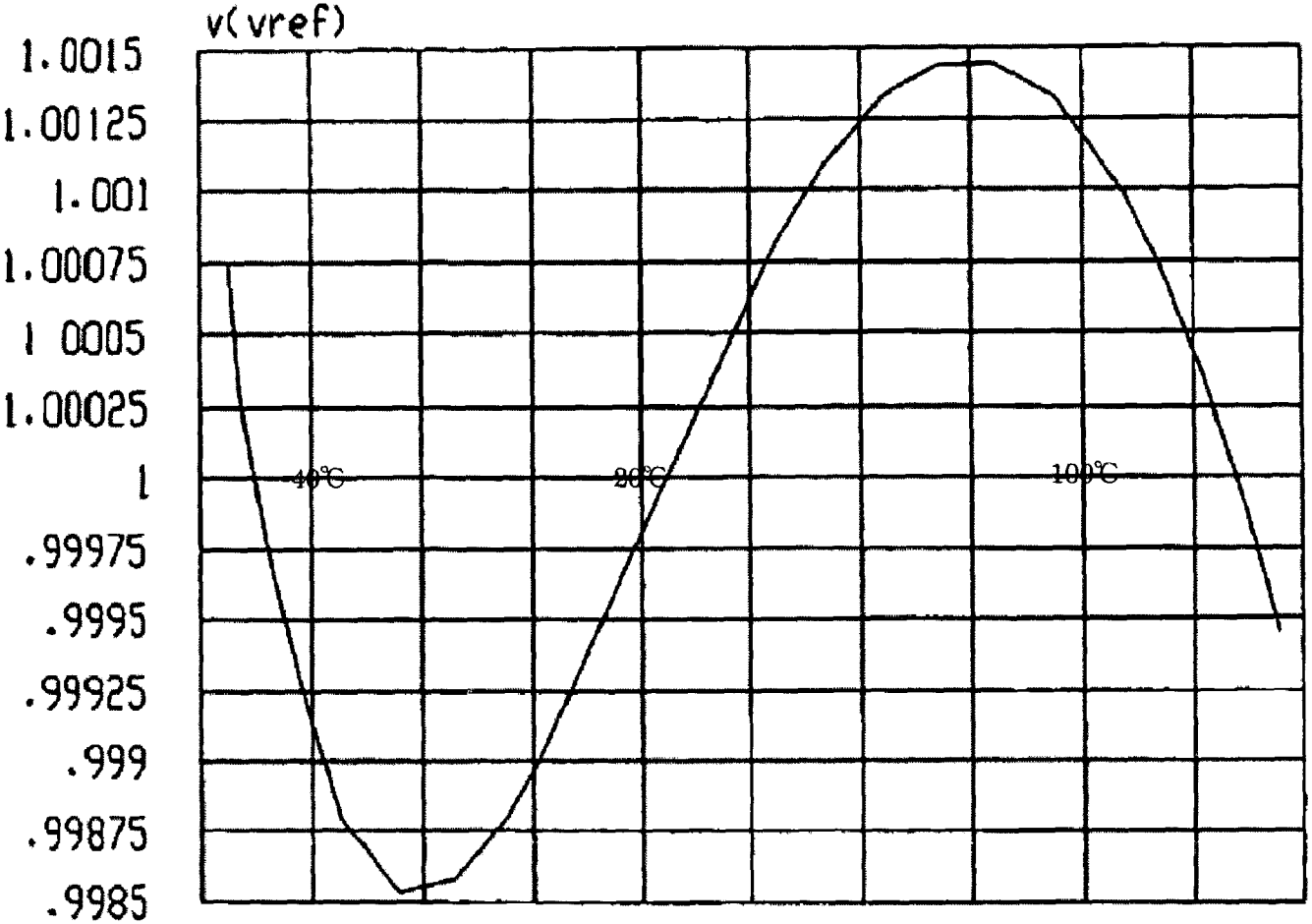
FIG. 8 CONVENTIONAL ART
FIG. 8 is a diagram (simulation) illustrating a characteristic obtained by the conventional voltage reference circuit proposed by Brokaw.
Figure 9:
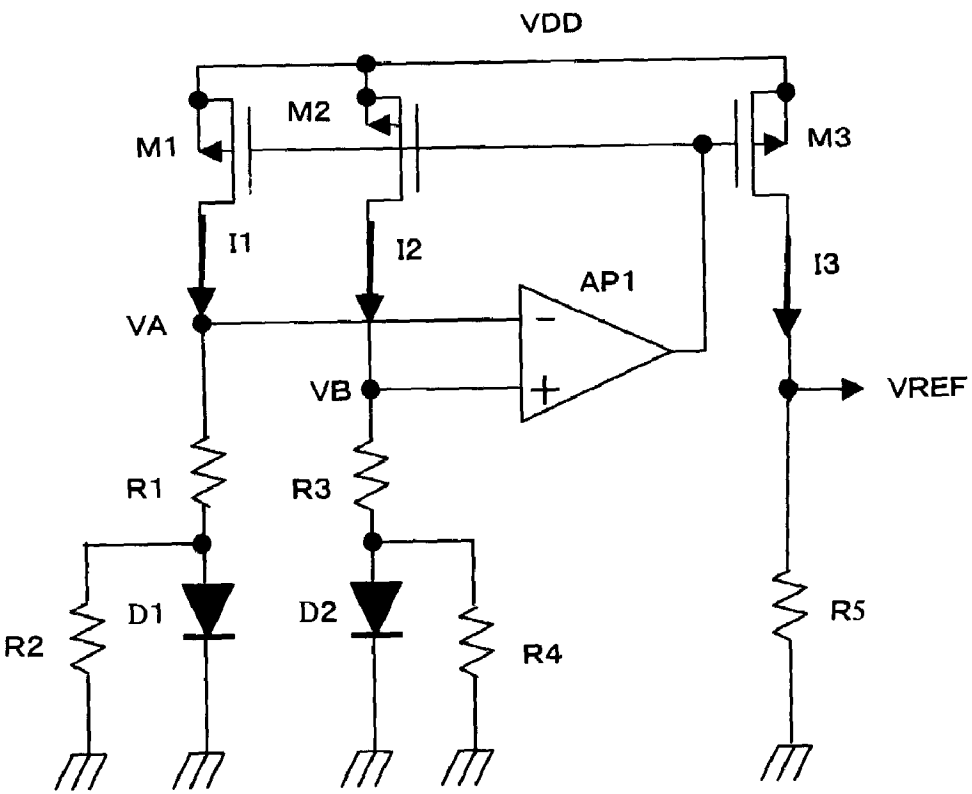
FIG. 9 CONVENTIONAL ART
FIG. 9 is a diagram illustrating an example of a voltage reference circuit proposed by Kimura.
Figure 10:
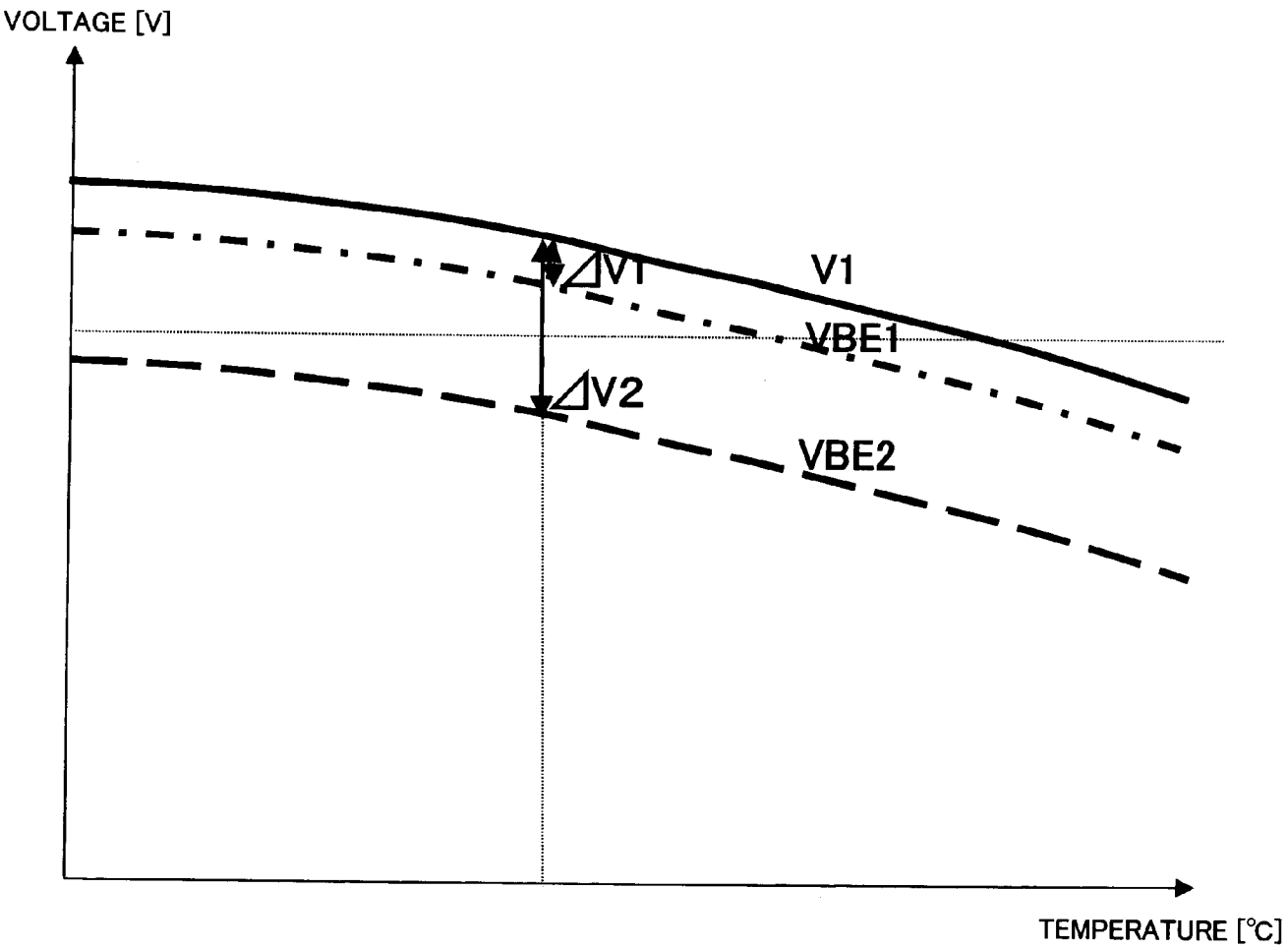
FIG. 10 CONVENTIONAL ART
FIG. 10 is a diagram useful in describing the operation of the voltage reference circuit proposed by Kimura.
Figure 11:
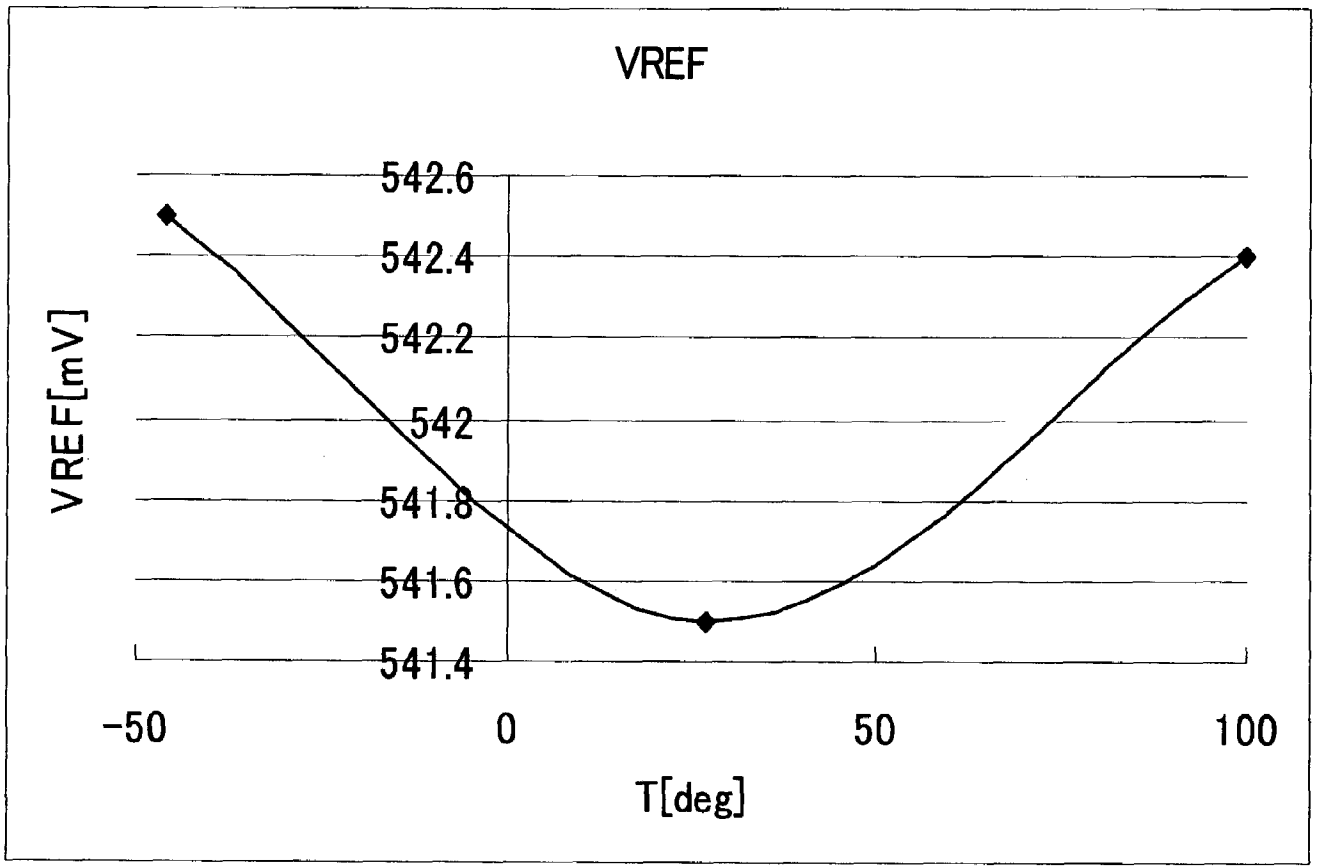
FIG. 11 CONVENTIONAL ART
FIG. 11 is a characteristic diagram (result of simulation) obtained by the voltage reference circuit proposed by Kimura.

Alternatively, as shown in FIG. 5, the first reference current circuit includes: a first current-to-voltage converting circuit comprising diode (D1); a second current-to-voltage converting circuit including a series circuit of parallel-connected diodes (D2) each having one end thereof grounded and a resistor (R1), and a separate resistor (R2) connected in parallel with the series circuit; first to third transistors (M1, M2 and M3) having sources (first terminals) connected in common to a power supply (VDD) and gates (control terminals) coupled together and constructing a first current mirror circuit; and a first differential amplifying circuit (AP1) having an inverting input terminal and a non-inverting input terminal respectively connected to a connection node of a terminal of the first current-to-voltage converting circuit (D1) and a drain (second terminal) of the first transistor (M1) and connection node of the second current-to-voltage converting circuit (D2, R1, R2) and a drain of the second transistor (M2), and an output terminal connected to the coupled gates of the first to third transistors (M1, M2 and M3).

The second reference current circuit includes: a third current-to-voltage converting circuit including a series circuit of parallel-connected diodes (D3) each having one end thereof grounded and a resistor (R3), and a separate resistor (R4) connected in parallel with the series circuit; fourth and fifth transistors (M4 and M5) having sources connected to the power supply and gates coupled together and constructing a second current mirror circuit; and a second differential amplifying circuit (AP2) having an inverting input terminal and a non-inverting input terminal respectively connected to the connection node (VA) of a terminal of the first current-to-voltage converting circuit (D1) and the drain of the first transistor (M1) and the connection node (VC) of a terminal of the third current-to-voltage converting circuit (D3, R3 and R4) and the drain of the fourth transistor (M4), and an output terminal connected to the coupled gates of fourth and fifth transistors (M4 and M5). The drain of third transistor (M3) is coupled to the drain of fourth transistor (M4) and connected to the non-inverting input terminal (+) of second differential amplifying circuit (AP2). Further provided is a resistor (R5), which has one end connected to the drain of fifth transistor (M5) and its other end grounded, forming a current-to-voltage converting circuit for receiving drain current of the fifth transistor (M5) and converting it to a voltage (Vref). In the first and second reference current circuits according to the present invention, the number of diodes in the second current-to-voltage converting circuit differs from the number of diodes in the third current-to-voltage converting circuit (i.e., the number of diodes D2 differs from the number of diodes D4), and the non-linearities of the temperature characteristics of these diodes are made to differ, thereby compensating for the temperature characteristic of the output voltage. In accordance with the present invention, the reason for this is that the temperature characteristic is cancelled out by two circuits in which non-linearity of diode temperature characteristics appears prominently. In accordance with the present invention, the effects of non-linear temperature characteristics of a diode are mitigated to achieve the enhancement in precision.

In accordance with the present invention, any desired output voltage equal to or greater than 1 V or less than 1 V is obtained and an improvement in characteristic and performance can be achieved. By making output voltage lower than 1 V, operation is possible from a voltage of 1.2 V and it is possible to lower voltage. The details of circuitry and operation of the present invention will now be described in detail.

EXAMPLES

FIG. 1 is a diagram illustrating the circuit configuration of an example of a CMOS voltage reference circuit according to the present invention.

Figure 12:
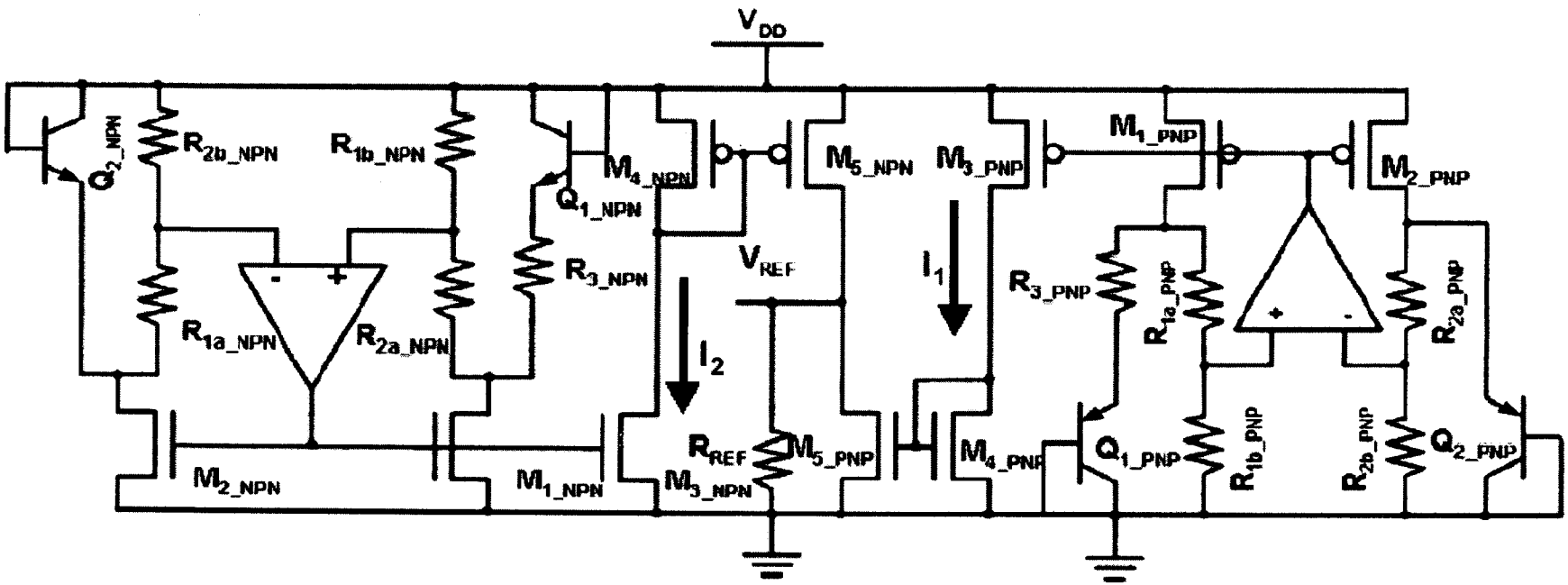
FIG. 12 CONVENTIONAL ART
FIG. 12 is a diagram illustrating the configuration of a conventional voltage reference circuit proposed by Ker et al.
Figure 13:
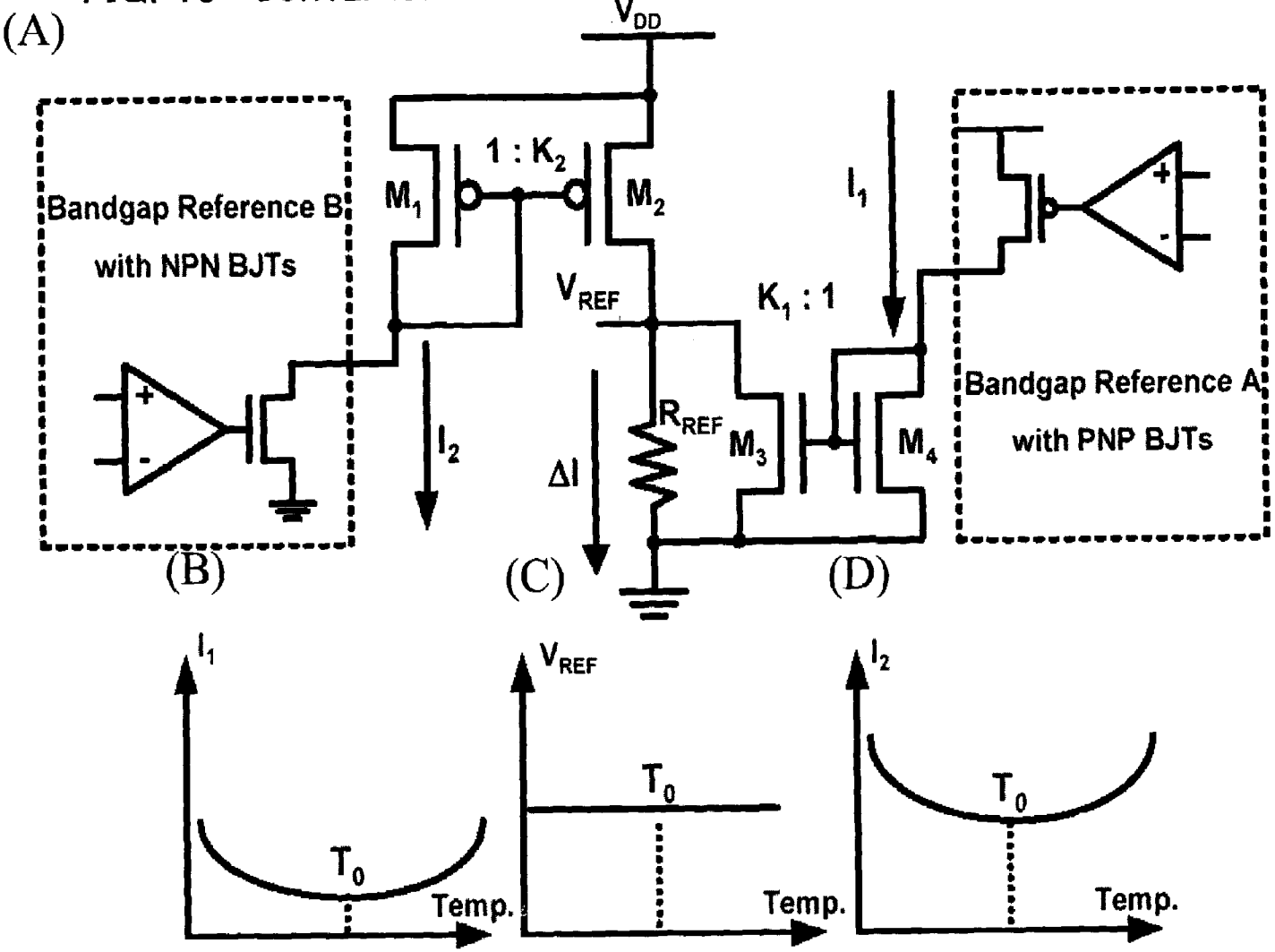
FIG. 13 CONVENTIONAL ART
FIG. 13 is a diagram useful in describing the operation of the conventional voltage reference circuit proposed by Ker et al.

In the circuit according to Ker et al. described above with reference to FIGS. 12 and 13, the temperature characteristic is cancelled out by taking the difference between output currents using a pnp transistor and p-ch transistor and an npn transistor and n-ch transistor. If the two reference current circuits are given the same circuit topology and relevant diodes or current mirror circuits from which the temperature characteristic is to be cancelled out are made only one of a pnp transistor or npn transistor or of a p-ch transistor or n-ch transistor, then it should not be difficult to imagine that the characteristics will agree and that the temperature characteristic can be cancelled out more accurately.

In an example of the present invention, as illustrated in FIG. 1, currents I1 and I2 are supplied to a first current-to-voltage converting circuit 101 and a second current-to-voltage converting circuit 102, respectively, via a first current mirror circuit 111, whereby the currents are converted to terminal voltages VA and VB, respectively. The terminal voltages VA and VB are applied to a first error-voltage amplifying circuit (differential amplifying circuit or operational amplifier) 121 as negative-phase and positive-phase input voltages, respectively.

The output voltage of the first error-voltage amplifying circuit 121 controls the first current mirror circuit 111 and operation is such that the respective terminal voltages of the first current-to-voltage converting circuit 101 and the second current-to-voltage converting circuit 102 become equal. More specifically, the output terminal of the first error-voltage amplifying circuit 121 is connected to the coupled gates of p-channel MOS transistors M1, M2 and M3 which have their sources connected in common to the power supply VDD and their gates coupled together and which construct first current mirror circuit 111. The connection node of the p-channel MOS transistor M1 and the first current-to-voltage converting circuit 101 and the connection node of the p-channel MOS transistor M2 and the second current-to-voltage converting circuit 102 are connected respectively to an inverting input terminal (−) and a non-inverting input terminal (+) of the first error-voltage amplifying circuit 121.

Further, a current I3 proportional to currents I1 and I2 is output via a drain of p-channel MOS transistor M3 of the first current mirror circuit 111. The first reference current circuit 1 is constructed by the first and second current-to-voltage converting circuits 101 and 102, first current mirror circuit 111 and first error-voltage amplifying circuit (AP1) 121.

Currents I4 and I5 are supplied to a third current-to-voltage converting circuit 103 and a fourth current-to-voltage converting circuit 104, respectively, via a second current mirror circuit 112, whereby the currents are converted to terminal voltages VC and VD, respectively. The terminal voltages VC and VD are applied to a second error-voltage amplifying circuit 122 as negative-phase and positive-phase input voltages, respectively.

The output voltage of the second error-voltage amplifying circuit 122 controls the second current mirror circuit 112 and operation is such that the terminal voltages of the third current-to-voltage converting circuit 103 and the fourth current-to-voltage converting circuit 104 become equal. More specifically, the output terminal of the second error-voltage amplifying circuit 122 is connected to the coupled gates of p-channel MOS transistors M4, M5 and M6 which have their sources connected in common to the power supply VDD and their gates coupled together and which construct the second current mirror circuit 112. The connection node of the p-channel MOS transistor M4 and the third current-to-voltage converting circuit 102 and the connection node of the p-channel MOS transistor M5 and the fourth current-to-voltage converting circuit 104 are connected respectively to an inverting input terminal (−) and a non-inverting input terminal (+) of second error-voltage amplifying circuit 122.

Further, a current I6 proportional to currents I4 and I5 is output from a drain of p-channel MOS transistor M6 of the second current mirror circuit 112.

The second reference current circuit 2 is constructed by the third and fourth current-to-voltage converting circuits 103 and 104, second current mirror circuit 112 and second error-voltage amplifying circuit (AP2) 122.

The current I6 that is output via the second current mirror circuit 112 is supplied to a subtractor circuit 130, which subtracts from the current I6 the current I3 that is output via the first current mirror circuit 111. The result is supplied to a fifth current-to-voltage converting circuit 105 as output current Iref, which supplies terminal voltage Vref.

Figure 2:
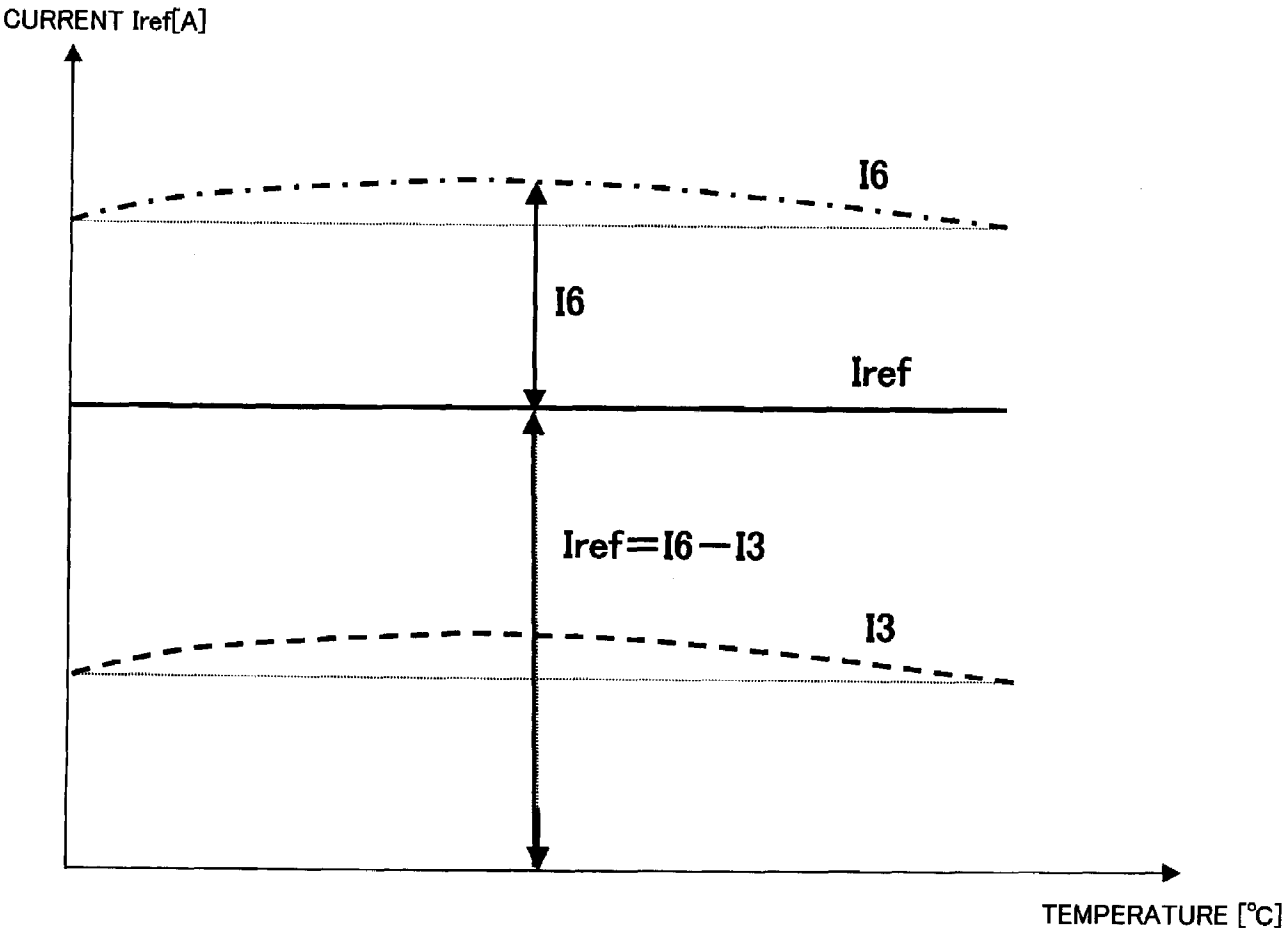
FIG. 2 is a diagram illustrating characteristics embodying the present invention.

As illustrated in FIG. 2, the non-linearity of the temperature characteristic of the current I3 that is output via the first current mirror circuit 111 is assumed to be greater, and the non-linearity of the temperature characteristic of the current I6 that is output via the second current mirror circuit 112 is assumed to be smaller. Current values I6 and, I3 can be found for which the non-linearity of the temperature characteristics can be cancelled out in a case where the value of $$Iref(=I6-I3)$$

is made positive.

It should be added that the temperature characteristic can be cancelled out more accurately if cancellation is performed between circuits in which the non-linearity of the temperature characteristic of a diode-connected transistor appears prominently than if cancellation is performed between circuits in which the non-linearity of the temperature characteristic of a diode-connected transistor does not appear prominently, as is the case in the circuit according to Banba.

A case where current-to-voltage converting circuits of the kind shown in FIG. 3 are applied will be described as an implementation of a concrete implementation of the first to fifth current-to-voltage converting circuits mentioned above. Generally, if the first (third) current-to-voltage converting circuit and the second (fourth) current-to-voltage converting circuit are identically constructed in such a circuit, the number of operating points will be infinite and indeterminate.

Accordingly, in this example, as illustrated in FIG. 3, the first (third) current-to-voltage converting circuit and the second (fourth) current-to-voltage converting circuit are made to have identical circuit topologies and the circuit constants are made different.

More specifically, the first current-to-voltage converting circuit 101 is formed by the single diode D1;

the third current-to-voltage converting circuit 103 is formed by the single diode D3; and in second current-to-voltage converting circuit 102, a resistor R1 is connected in series with parallel diode D2, and the resistor R1 and diodes D2 (two parallel diodes) are connected in parallel with a resistor R2.

Furthermore, in the second current-to-voltage converting circuit 102 and fourth current-to-voltage converting circuit 104, the number of multiple diodes D2 connected in parallel and the number of multiple diodes D4 connected in parallel are made two and four, respectively, an output current I3 from the first reference current circuit and an output current I6 from the second reference current circuit are made different from each other, and it is so designed that non-linearities of the diode temperature characteristics are different. Operation will now be described.

If we assume that the forward voltages of diodes (or diode-connected bipolar transistors) D1 and D2 are VF1 and VF2, respectively, negative-phase and positive-phase input terminal voltages are controlled by the operational amplifier AP1 so as to become equal (VA=VB).

Accordingly, the following holds:

$$VA=VB=VF1 \tag{23}$$

If we assume for the sake of simplicity that the currents of MOS transistors M1 and M2 are equal, then we have the following:

$$I1=I2 \tag{24}$$

However, whereas the current I1 flows directly into the diode D1, which constitutes the first current-to-voltage converting circuit, and is converted to a voltage, the current I2 is split into a current that flows into diodes D2 of the second current-to-voltage converting circuit via the resistor R1 and a current that flows into the resistor R2. Accordingly, we have the following:

$$I1=I2=(VF1-VF2)/R1+VF1/R2$$

$$=[VF1+(R2/R1)\Delta VF]R2 \tag{25}$$

Here VF1 has a temperature characteristic (temperature coefficient) of about −1.9 mV° C. Further, VF2 also has a temperature characteristic (temperature coefficient) of about −1.9 mV° C.

If D1 is a unit diode and D2 is n times the unit diode, then ΔVF (=VF1−VF2) will be expressed by Equation (26) below.

$$\Delta VF=VT\ln\{n[I1/(I2-VF1/R2)]\} \quad (26)$$

Since $$I1=I2 \quad (27)$$

holds, the following holds at all times:

$$I1>(I2-VF1/R2) \quad (28)$$

and the following holds:

$$I1/(I2-VF1/R2)>1 \quad (29)$$

Accordingly, it will be understood that the ln term in Equation (26) is always positive (>0). That is, ΔVF possesses a positive temperature characteristic in this circuit as well, as is well known.

This temperature characteristic, therefore, is approximately proportional to a thermal temperature VT (the temperature characteristic of which is 0.0853 mV° C.).

That is, the temperature characteristic of the [VF1+(R2/R1)ΔVF] term in Equation (25) can be substantially cancelled out by performing the weighted addition of VF1 having a negative temperature characteristic and ΔVF having a positive temperature characteristic upon setting the resistor ratio (R2/R1).

Examining this more closely, VF1 has a negative temperature characteristic of about −1.9 mV° C., and a current (=VF1/R2) has a negative temperature characteristic.

Accordingly, n[I1/(I2−VF1/R2)] in Equation (26) has a negative temperature characteristic, and logarithmic value ln {n[I1/(I2−VF1/R2)]} thereof has a somewhat negative temperature characteristic.

That is, in Equation (25), the term VF1 has a negative temperature characteristic, and the term ΔVF has a positive temperature characteristic. However, the term ΔVF is represented by the product of VT having a positive temperature characteristic and ln {n[I1/(I2−VF1/R2)]} having a negative temperature characteristic.

What is noteworthy here is the current (VF1/R2) term. Non-linearity of a temperature characteristic of the diode forward voltage VF appears in the term (VF1/R2), and non-linearity of a temperature characteristic of VF, which appears in the term VF1 having a negative temperature characteristic, and non-linearity of a temperature characteristic of VF, which appears in the term ΔVF having a positive temperature characteristic, appear in the term (VF1/R2) in superimposed form.

Accordingly, non-linearity of a temperature characteristic of VF appears in the output current I3 of the reference current circuit more conspicuously than in the circuit according to Banba described in detail above. Moreover, the effects thereof can be changed and set by the resistor R2.

Furthermore, output currents I3 and I4 of the first reference current circuit proportional to currents I1 and I2 are supplied respectively to the third current-to-voltage converting circuit comprising diode D3 and to the fourth current-to-voltage converting circuit comprising diodes D4 and resistor R3.

Similarly, if we assume that the forward voltages of diodes (or diode-connected bipolar transistor) D3 and D4 are VF3 and VF4, respectively, negative-phase and positive-phase input terminal voltages are controlled by the operational amplifier AP2 so as to become equal (VC=VD).

Accordingly, the following holds:

$$VC=VD=VF3 \quad (30)$$

If we assume for the sake of simplicity that the currents of MOS transistors M5 and M6 are equal, then we have the following:

$$I5=I6 \quad (31)$$

However, whereas the current I5 flows directly into the diode D3, which constitutes the third current-to-voltage converting circuit, and is converted to a voltage, the current I6 is split into a current that flows into diodes D4 of the fourth current-to-voltage converting circuit via the resistor R3 and a current that flows into the resistor R4. Accordingly, we have the following:

$$\begin{aligned} I4+I5&=I3+I6\\ &=(VF3-VF4)/R3+VF3/R4\\ &=[VF3+(R4/R3)\Delta VF\hat{}]R4 \end{aligned} \quad (32)$$

Here VF3 has a temperature characteristic (temperature coefficient) of about −1.9 mV° C. Further, VF4 also has a temperature characteristic (temperature coefficient) of about −1.9 mV° C.

If D3 is a unit diode and D4 is n^ times the unit diode, then ΔVF (=VF1−VF2) will be expressed by Equation (33) below.

$$\Delta VF\hat{}=VT\ln\{n\hat{}[(I4+I5)/(I3+I6-VF3/R4)]\} \quad (33)$$

Since $$I3=I4,\ I5=I6 \quad (34)$$

holds, we have the following:

$$I3+I4=I3+I6 \quad (35)$$

Accordingly, the following holds at all times:

$$(I4+I5)>(I3+I6-VF3/R4) \quad (36)$$

and the following holds:

$$(I4+I5)/(I3+I6-VF3/R4)>1 \quad (37)$$

Accordingly, it will be understood that the ln term in Equation (33) is always positive (>0). That is, ΔVF^ possesses a positive temperature characteristic in this circuit as well, as is well known. This temperature characteristic, therefore, is approximately proportional to a thermal temperature VT (the temperature characteristic of which is 0.0853 mV° C.).

That is, the temperature characteristic of the [VF3+(R4/R3)ΔVF^] term in Equation (32) can be substantially cancelled out by performing the weighted addition of VF3 having the negative temperature characteristic and ΔVF^ having the positive temperature characteristic upon setting the resistor ratio (R4/R3).

Examining this more closely, VF3 has a negative temperature characteristic of about −1.9 mV° C., and a current (VF3/R4) has a negative temperature characteristic.

Accordingly, the term n^[(I4+I5)/(I3+I6−VF3/R4)] in Equation (33) has a negative temperature characteristic, and logarithmic value ln {n^[(I4+I5)/(I3+I6−VF3/R4)]} thereof has a somewhat negative temperature characteristic.

That is, in Equation (32), the term VF3 has a negative temperature characteristic, and the term ΔVF^ has a positive temperature characteristic. However, the term ΔVF^ is represented by the product of VT having a positive temperature characteristic and ln {n^[(I4+I5)/(I3+I6−VF3/R4)]} having a negative temperature characteristic.

What is noteworthy here is the term of current (VF3/R4). Non-linearity of a temperature characteristic of VF appears in the term (VF3/R4), and non-linearity of a temperature characteristic of VF, which appears in the term VF3 having a negative temperature characteristic, and non-linearity of a temperature characteristic of VF, which appears in the term ΔVF^ having a positive temperature characteristic, appear in the term (VF3/R4) in superimposed form.

Accordingly, non-linearity of a temperature characteristic of VF appears in drive currents (I4+I5) and (I3+I6) internally of this reference current circuit more conspicuously than in the circuit according to Banba described in detail above. Moreover, the effects thereof can be changed and set by the resistor R4.

On the other hand, output current I7 of the second reference current circuit is a current that is proportional to the currents I5 and I6. The drive currents (I4+I5) and (I3+I6) within the second reference current circuit are supplied with output currents I3 and I4 of the first reference current circuit. Therefore, n is set to a small value in the first reference current circuit, n^ is set to a large value in the second reference current circuit and R1<R3 is made to hold. As a result, it is so set that the non-linearity of a temperature characteristic of VF appears prominently in drive currents I1 and I2 within the first reference current circuit.

Conversely, if it is so set that the non-linearity of a temperature characteristic of VF does not appear that prominently in the drive currents (I4+I5) and (I3+I6) within the second reference current circuit, then it will be possible to so arrange it that the non-linearity of a temperature characteristic of VF that appears in the drive currents (I4+I5) and (I3+I6) within the second reference current circuit will be the same as the non-linearity of a temperature characteristic of VF possessed by output currents I3 and I4 supplied from the first reference current circuit.

Accordingly, an output current I7 of the second reference current circuit can be set to a current from which the non-linearity of a temperature characteristic of VF has been excluded. That is, output current I7 of the second reference current circuit can be set to a constant current from which the temperature characteristic has been cancelled out sufficiently.

In view of the detailed description of operation set forth above, it will be understood that a function is implemented in which the output currents I3, I4 of the first reference current circuit are subtracted from the drive currents within the second reference current circuit by supplying the output currents I4, I3 of the first reference current circuit to the third current-to-voltage converting circuit comprising diode D3 and to the fourth current-to-voltage converting circuit comprising diodes D4 and resistors R3, R4, respectively.

EXAMPLE OF RESULT OF SIMULATION

Figure 4:
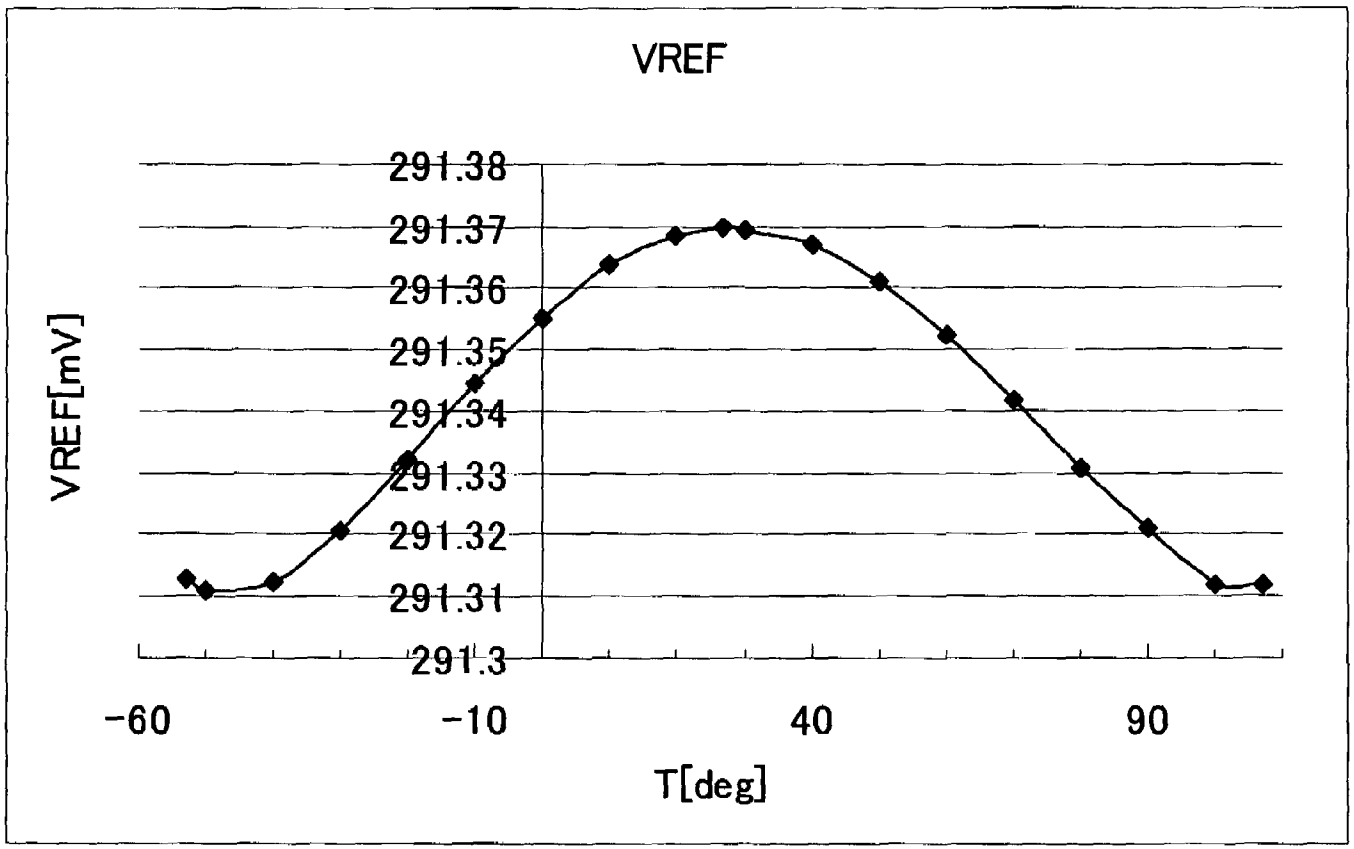
FIG. 4 is a diagram illustrating a characteristic (result of a simulation) according to the first example.

The result of a simulation illustrated in FIG. 4 was obtained as an example of a SPICE simulation in a case where VDD=1.2 V, R1=3.74 KΩ, R2=200 KΩ, R3=8 KΩ, R4=200 KΩ, R5=100 KΩ hold, D1, D3 are set to be a unit diode (×1), D2 is set to be twice (×2) the unit diode, D4 is set to be four times (×4) the unit diode, the current ratio of the first current mirror circuit is set to M1:M2:M3:M4=2:2:1.2:1.2, and the current ratio of the second current mirror circuit is set to M5:M6:M7=2:2:2.

The value of VREF is maximum at ordinary temperatures, and voltage decreases minutely at low and high temperatures. Hence the temperature characteristic obtained had a very slight inverted bowl-shaped appearance, and 291.3128 mV, 291.3697 mV and 291.3119 mV were obtained at −53° C., 29° C., 107° C., respectively. The temperature characteristic is an extremely small −0.020146% (−60 μV) over a 160° C. temperature range.

SECOND EXAMPLE

The output of the first reference current circuit may be made a single output and the circuitry may be changes as shown in FIG. 5. In FIG. 5, the first reference current circuit is so adapted that the MOS transistors M1, M2, M3 construct a first current mirror circuit, and the common gate voltage is controlled by the operational amplifier AP1 in such a manner that the negative-phase and positive-phase input terminal voltages will be equal, as a result of which the current that flows into the first current mirror circuit is decided.

The negative-phase and positive-phase input terminals of the operational amplifier AP1 are connected respectively to the first current-to-voltage converting circuit, which comprises diode D1, and to the second current-to-voltage converting circuit comprising serially connected diodes D2 and resistor R1 and resistor R2 connected in parallel with this series circuit.

Further, the second reference current circuit is so adapted that the MOS transistors M4 and M5 construct a second current mirror circuit, and the common gate voltage is controlled by the operational amplifier AP2 in such a manner that the negative-phase and positive-phase input terminal voltages will be equal, as a result of which the current that flows into the second current mirror circuit is decided.

The negative-phase and positive-phase input terminals of the operational amplifier AP2 are connected respectively to the first current-to-voltage converting circuit, which comprises diode D1, and to the third current-to-voltage converting circuit comprising serially connected diodes D3 and resistor R3 and resistor R4 connected in parallel with this series circuit.

In this example, the change from the first example of FIG. 3 is that the first current-to-voltage converting circuit is shared by the first and second reference current circuits and the output from the first reference current circuit is reduced to a single output. The first reference current circuit comprises the first current-to-voltage converting circuit, which is composed of diode D1, and the second current-to-voltage converting circuit comprising diodes D2 and resistors R1, R2. The second reference current circuit comprises the first current-to-voltage converting circuit, which is shared by the first reference current circuit, and the third current-to-voltage converting circuit comprising diodes D3 and resistors R3 and R4.

The third current-to-voltage converting circuit comprising diodes D3 and resistors R3 and R4 is supplied simultaneously with current I3, which is output from the first reference current circuit via the first current mirror circuit, and current I4, which is supplied from the second current mirror circuit.

In FIG. 5, if we assume that the forward voltages of diodes (or diode-connected bipolar transistors) D1 and D2 are VF1 and VF2, respectively, negative-phase and positive-phase input terminal voltages are controlled by the operational amplifier AP1 so as to become equal (VA=VB).

Accordingly, the following holds:

$$VA=VB=VF1 \quad (38)$$

If we assume for the sake of simplicity that the currents I1 and IS 5f MOS transistors M1 and M2 are equal, then we have the following:

$$I1=I2 \quad (39)$$

The current I1 flows directly into diode D1, which constitutes the first current-to-voltage converting circuit, and is converted to a voltage, The current I2 is split into current that flows into diodes D2 of the second current-to-voltage converting circuit via resistor R1 and current that flows into resistor R2 of this circuit. Accordingly, we have the following:

$$I1=I2=(VF1-VF2)/R1+VF1/R2$$

$$=[VF1+(R2/R1)\Delta VF]R2 \quad (40)$$

Here VF1 has a temperature characteristic (temperature coefficient) of about −1.9 mV° C. Further, VF2 also has a temperature characteristic (temperature coefficient) of about −1.9 mV° C.

If D1 is a unit diode and D2 is n times the unit diode, then we have the following:

$$\Delta VF=VT \ln \{n[I1/(I2-VF1/R2)]\} \quad (41)$$

Since $$I1=I2 \quad (42)$$

holds, the following holds at all times:

$$I1>(I2-VF1/R2) \quad (43)$$

and the following holds:

$$I1/(I2-VF1/R2)>1 \quad (44)$$

Accordingly, it will be understood that the ln term in Equation (41) is always positive (>0).

That is, ΔVF possesses a positive temperature characteristic in this circuit as well, as is well known. This temperature characteristic, therefore, is approximately proportional to a thermal temperature VT (the temperature characteristic of which is 0.0853 mV° C.).

That is, the temperature characteristic of the [VF1+(R2/R1)ΔVF] term in Equation (40) can be substantially cancelled out by performing the weighted addition of VF1 having the negative temperature characteristic and ΔVF having the positive temperature characteristic upon setting the resistor ratio (R2/R1).

Examining this more closely, VF1 has a negative temperature characteristic of about −1.9 mV° C., and current (VF1/R2) has a negative temperature characteristic.

Accordingly, n[I1/(I2−VF1/R2)] has a negative temperature characteristic, and logarithmic value ln {n[I1/(I2−VF1/R2)]} has a somewhat negative temperature characteristic.

That is, in Equation (41), the term VF1 has a negative temperature characteristic, and the term ΔVF has a positive temperature characteristic. However, the term ΔVF is represented by the product of VT having the positive temperature characteristic and ln {n[I1/(I2−VF1/R2)]} having the negative temperature characteristic.

What is noteworthy here is the current (VF1/R2) term. Non-linearity of the temperature characteristic of VF appears in the term (VF1/R2), and the non-linearity of a temperature characteristic of VF, which appears in the term VF1 having the negative temperature characteristic, and the non-linearity of a temperature characteristic of VF, which appears in the term ΔVF having the positive temperature characteristic, appear in the term (VF1/R2) in superimposed form.

Accordingly, the non-linearity of a temperature characteristic of VF appears in the output current I3 of the reference current circuit more conspicuously than in the circuit according to Banba described in detail above. Moreover, the effects thereof can be changed and set by the resistor R2.

Furthermore, output current I3 of the first reference current circuit proportional to currents I1 and I2 is supplied to the third current-to-voltage converting circuit comprising diodes D3 and resistors R3 and R4.

Similarly, if we assume that the forward voltage of diode (or diode-connected bipolar transistor) D3 is VF3, negative-phase and positive-phase input terminal voltages are controlled by the operational amplifier AP2 so as to become equal (VC=VA).

Accordingly, the following holds:

$$VA=VC=VF1 \quad (45)$$

If we assume for the sake of simplicity that currents I1 and I2 of MOS transistors M1 and M2 and the sum I3+I4 of currents of MOS transistors M3 and M4 are equal, then we have the following:

$$I1=I2=I3+I4 \quad (46)$$

However, current (I3+I4) supplied to the third current-to-voltage converting circuit is split into current that flows into diodes D3 via resistor R3 and current that flows into resistor R4. Accordingly, we have the following:

$$I3+I4=(VF1-VF3)/R3+VF1/R4$$

$$=[VF1+(R4/R3)\Delta VF^{\wedge}]R4 \quad (47)$$

Here VF1 has a temperature characteristic of about −1.9 mV° C. Further, VF3 also has a temperature characteristic of about −1.9 mV° C.

If D3 is n^ times the unit diode, then ΔVF^ (=VF1−VF3) will be expressed as follows:

$$\Delta VF^{\wedge}=VT \ln \{n^{\wedge}[I1/(I3+I4-VF1/R4)]\} \quad (48)$$

Here we have $$I3+I4=I1 \quad (49)$$

Accordingly, the following holds at all times:

$$I3>(I3+I4-VF1/R4) \quad (50)$$

and the following holds:

$$I1/(I3+I4-VF1/R4)>1 \quad (51)$$

Accordingly, it will be understood that the ln term in Equation (48) is always positive (>0).

That is, ΔVF^ possesses a positive temperature characteristic in this circuit as well, as is well known. This temperature characteristic, therefore, is approximately proportional to a thermal temperature VT (the temperature characteristic of which is 0.0853 mV° C.).

That is, the temperature characteristic of the term [VF1+(R4/R3)ΔVF^] in Equation (47) can be substantially cancelled out by performing the weighted addition of VF1 having the negative temperature characteristic and ΔVF^ having the positive temperature characteristic upon setting the resistor ratio (R4/R3).

Examining this more closely, VF1 has a negative temperature characteristic of about −1.9 mV° C., and current (VF3/R4) has a negative temperature characteristic.

Accordingly, the term n^[I1/(I3+I4−VF1/R4)] in Equation (47) has a negative temperature characteristic, and logarithmic value ln {n^[I1/(I3+I4−VF1/R4)]} thereof has a somewhat negative temperature characteristic.

That is, in Equation (48), the term VF1 has a negative temperature characteristic, and the term ΔVF^ has a positive temperature characteristic. However, the term ΔVF^ is represented by the product of VT having the positive temperature characteristic and ln {n^[I1/(I3+I4−VF1/R4)]} having the negative temperature characteristic.

What is noteworthy here is the current term (VF3/R4). Non-linearity of the temperature characteristic of VF appears in the term (VF3/R4), and the non-linearity of a temperature characteristic of VF, which appears in the term VF1 having the negative temperature characteristic, and the non-linearity of a temperature characteristic of VF, which appears in the term ΔVF^ having the positive temperature characteristic, appear in the term (VF3/R4) in superimposed form.

Accordingly, the non-linearity of a temperature characteristic of VF appears in drive current (I3+I4) internally of this reference current circuit more conspicuously than in the circuit according to Banba described in detail above. Moreover, the effects thereof can be changed and set by the resistor R4.

On the other hand, the output current I5 of the second reference current circuit is a current that is proportional to the current I4. The drive current (I3+I4) within the second reference current circuit is supplied with output current I3 of the first reference current circuit.

Therefore, n (D2 is n times D1) is set to a small value in the first reference current circuit;

n^ (D3 is n^ times D1) is set to a large value in the second reference current circuit; and R1<R3 is made to hold.

As a result, it is so set that the non-linearity of a temperature characteristic of VF appears prominently in drive currents I1 and I2 within the first reference current circuit.

Conversely, if it is so set that the non-linearity of a temperature characteristic of VF does not appear that prominently in the drive current (I3+I4) within the second reference current circuit, then it will be possible to so arrange it that the non-linearity of a temperature characteristic of VF that appears in the drive current (I3+I4) within the second reference current circuit will be the same as the non-linearity of a temperature characteristic of VF possessed by output current I3 supplied from the first reference current circuit.

Accordingly, an output current I5 of the second reference current circuit can be set to a current from which the non-linearity of a temperature characteristic of VF has been excluded. That is, the output current I5 of the second reference current circuit can be set to a constant current from which the temperature characteristic has been cancelled out sufficiently.

In view of the detailed description of operation set forth above, it will be understood that a function is implemented in which the output current I3 of the first reference current circuit is subtracted from the drive current within the second reference current circuit by supplying the output current I3 of the first reference current circuit to the third current-to-voltage converting circuit comprising diodes D3 and resistors R3 and R4.

Various voltage reference circuits integrated on an LSI chip can be mentioned as an example of use of the present invention. In particular, recent advances in terms of the formation of ever finer patterns in IC processes have been accompanied by a reduction in the power-supply voltage supplied to LSI circuits. Hence there is now need for stable voltage reference circuits that are free of temperature fluctuation and that operate at power-supply voltages of about 1 V. The present invention satisfies this need.

Though the present invention has been described in accordance with the foregoing examples, the invention is not limited to this example and it goes without saying that the invention covers various modifications and changes that would be obvious to those skilled in the art within the scope of the claims.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A voltage reference circuit comprising:

a first reference current circuit including:

first and second current-to-voltage converting circuits, each of which receives a current and converts the current to a voltage to output the so converted voltage;

a first control circuit that exercises control in such a manner that an output voltage of said first current-to-voltage converting circuit and an output voltage of said second current-to-voltage converting circuit will be equal to each other; and a first current mirror circuit that supplies currents to respective ones of said first and second current-to-voltage converting circuits; said first current mirror circuit generating a current used for an output current of said first reference current circuit;

a second reference current circuit including:

third and fourth current-to-voltage converting circuits, each of which receives a current and converts the current to a voltage to output the so converted voltage;

a second control circuit that exercises control in such a manner that an output voltage of said third current-to-voltage converting circuit and an output voltage of said fourth current-to-voltage converting circuit will be equal to each other; and a second current mirror circuit that supplies currents to respective ones of said third and fourth current-to-voltage converting circuits; said second current mirror circuit generating a current used for an output current of said second reference current circuit;

a circuit that generates a difference current between the output current of said first reference current circuit and the output current of said second reference current circuit; and a fifth current-to-voltage converting circuit that converts the difference current to a voltage and outputs the so converted voltage as an output voltage of said voltage reference circuit.

2. The circuit according to claim 1, wherein each of said first and second current mirror circuits is a linear current mirror circuit having a linear input/output characteristic.

3. The circuit according to claim 1, wherein said circuit that outputs the difference current between the output currents of said first and second reference current circuits is adapted so as to inject currents, which are proportional to an output current of said first current mirror circuit, into respective ones of said third and fourth current-to-voltage converting circuits; and wherein said fifth current-to-voltage converting circuit receives an output current of said second current mirror circuit, which corresponds to said difference current between the output currents of said first and second reference current circuits, and outputs said output voltage of said voltage reference circuit.

4. The circuit according to claim 1, wherein each of said first and third current-to-voltage converting circuits comprises a diode;

said second current-to-voltage converting circuit includes a series circuit, which comprises one diode or a plurality of parallel-connected diodes and a first resistor connected in series with said one diode or plurality of parallel-connected diodes, and a second resistor connected in parallel with the series circuit;

said fourth current-to-voltage converting circuit includes a series circuit, which comprises one diode or a plurality of parallel-connected diodes and a third resistor connected in series with said one diode or plurality of parallel-connected diodes, and a fourth resistor connected in parallel with the series circuit; and said fifth current-to-voltage converting circuit comprises a resistor.

5. The circuit according to claim 1, wherein said first control circuit comprises a first differential amplifying circuit that receives differentially the output voltage of said first current-to-voltage converting circuit and the output voltage of said second current-to-voltage converting circuit and delivers an output voltage from an output terminal for controlling a common node of said first current mirror circuit; and said second control circuit comprises a second differential amplifying circuit that receives differentially the output voltage of said third current-to-voltage converting circuit and the output voltage of said fourth current-to-voltage converting circuit and delivers an output voltage from an output terminal for controlling a common node of said second current mirror circuit.

6. The circuit according to claim 4, wherein at least said second and fourth current-to-voltage converting circuits have circuit topologies and/or element values that differ from each other.

7. The circuit according to claim 6, wherein said second and fourth current-to-voltage converting circuits have different numbers of diodes from each other, and non-linearities of temperature characteristics of diodes in said first and second reference current circuits are made to differ from each other.

8. The circuit according to claim 6, wherein the first resistor in said second current-to-voltage converting circuit and the third resistor in said fourth current-to-voltage converting circuit are made to have values that are different from each other, and output current values of said first and second reference current circuits are made different from each other.

9. The circuit according to claim 4, wherein at least one diode comprises a diode-connected bipolar transistor.

10. The circuit according to claim 1, wherein said first current mirror circuit includes first to third transistors having first terminals connected in common to a first power supply and control terminals coupled together;

said first control circuit includes a first differential amplifying circuit having first and second input terminals, which form differential inputs, connected respectively to a connection node of said first current-to-voltage converting circuit and the second terminal of said first transistor, and to a connection node of said second current-to-voltage converting circuit and the second terminal of said second transistor, and further having an output terminal connected to the coupled control terminals of said first to third transistors; the output current of said first reference current circuit being supplied from said third transistor;

said second current mirror circuit includes fourth to sixth transistors having first terminals connected in common to the first power supply and control terminals coupled together;

said second control circuit includes a second differential amplifying circuit having first and second input terminals, which form differential inputs, connected respectively to a connection node of said third current-to-voltage converting circuit and the second terminal of said fourth transistor, and to a connection node of said fourth current-to-voltage converting circuit and the second terminal of said fifth transistor, and further having an output terminal connected to the coupled control terminals of said fourth to sixth transistors; the output current of said second reference current circuit being supplied from said sixth transistor;

said first and third current-to-voltage converting circuits each comprises a diode having one end connected to a second power supply;

said second and fourth current-to-voltage converting circuits each comprises: a series circuit, which has one diode with one end thereof connected to the second power supply or a plurality of parallel-connected diodes with one ends thereof connected to the second power supply, and a resistor; and a separate resistor connected in parallel with the series circuit; and said fifth current-to-voltage converting circuit comprises a resistor having one end connected to the second power supply.

11. A semiconductor integrated circuit having a voltage reference circuit set forth in claim 1.

12. The circuit according to claim 10, wherein at least one diode comprises a diode-connected bipolar transistor.

13. A reference current circuit comprising:

a first reference current circuit including:

first and second current-to-voltage converting circuits, each of which receives a current and converts the current to a voltage to output the so converted voltage from a terminal thereof;

first to fourth transistors constituting a first current mirror circuit and having first terminals connected in common to a first power supply and control terminals coupled together; and a first differential amplifying circuit having first and second input terminals, which form differential inputs, connected respectively to a connection node of the terminal of said first current-to-voltage converting circuit and a second terminal of said first transistor, and to a connection node of the terminal of said second current-to-voltage converting circuit and a second terminal of said second transistor, and further having an output terminal connected to the coupled control terminals of said first to fourth transistors;

a second reference current circuit including:

third and fourth current-to-voltage converting circuits, each of which receives a current and converts the current to a voltage to output the so converted voltage from a terminal thereof;

fifth to seventh transistors constituting a second current mirror circuit and having first terminals connected in common to the first power supply and control terminals coupled together; and a second differential amplifying circuit having first and second input terminals, which form differential inputs, connected respectively to a connection node of the terminal of said third current-to-voltage converting circuit and a second terminal of said fifth transistor, and to a connection node of the terminal of said fourth current-to-voltage converting circuit and a second terminal of said sixth transistor, and further having an output terminal connected to the coupled control terminals of said fifth to seventh transistors;

wherein a second terminal of said third transistor is connected to a common connection node of the terminal of said fourth current-to-voltage converting circuit, the second terminal of said sixth transistor and the second input terminal of said second differential amplifying circuit;

a second terminal of said fourth transistor is connected to a common connection node of the terminal of said third current-to-voltage converting circuit, the second terminal of said fifth transistor and the first input terminal of said second differential amplifying circuit;

each of said first and third current-to-voltage converting circuits comprises a diode having one end connected to a second power supply and having the other end connected to the terminal of each of said first and third current-to-voltage converting circuits;

each of said second and fourth current-to-voltage converting circuits comprises: a series circuit, which has one diode with one end thereof connected to the second power supply or a plurality of parallel-connected diodes with one ends thereof connected to the second power supply, and a resistor; and a separate resistor connected in parallel with the series circuit; said resistor and said separate resistor being connected in common to the terminal of each of said second and fourth current-to-voltage converting circuits; and a fifth current-to-voltage converting circuit including a resistor having one end connected to a second terminal of said seventh transistor and another end connected to the second power supply.

14. The circuit according to claim 13, wherein in said first and second reference current circuits, said second and fourth current-to-voltage converting circuits have different numbers of diodes from each other, and non-linearities of temperature characteristics of the diodes are made to differ from each other, thereby compensating for a temperature characteristic of output voltage.

15. The circuit according to claim 14, wherein the separate resistor in said second current-to-voltage converting circuit and the separate resistor in said fourth current-to-voltage converting circuit are made to have values that are different from each other, and output current values of said first and second reference current circuits are made different from each other.

16. The circuit according to claim 13, wherein at least one diode comprises a diode-connected bipolar transistor.

17. A voltage reference circuit comprising:

a first reference current circuit including:

first and second current-to-voltage converting circuits, each of which receives a current and converts the current to a voltage to output the so converted voltage from a terminal thereof;

first to third transistors constituting a first current mirror circuit and having first terminals connected in common to a first power supply and control terminals coupled together; and a first differential amplifying circuit having first and second input terminals, which form differential inputs, connected respectively to a connection node of the terminal of said first current-to-voltage converting circuit and a second terminal of said first transistor, and to a connection node of the terminal said second current-to-voltage converting circuit and a second terminal of said second transistor, and further having an output terminal connected to the coupled control terminals of said first to third transistors;

a second reference current circuit including:

a third current-to-voltage converting circuit that receives a current and converts the current to a voltage to output the so converted voltage from a terminal thereof;

fourth and fifth transistors constituting a second current mirror circuit and having first terminals connected in common to the first power supply and control terminals coupled together; and a second differential amplifying circuit having first and second input terminals, which form differential inputs, connected respectively to a connection node of the terminal of said first current-to-voltage converting circuit and a second terminal of said first transistor, and to a connection node of the terminal of said third current-to-voltage converting circuit and a second terminal of said fourth transistor, and further having an output connected to the coupled control terminals of said fourth and fifth transistors;

wherein a second terminal of said third transistor is connected to a common connection node of the terminal of said third current-to-voltage converting circuit, the second terminal of said fourth transistor and the second input terminal of said second differential amplifying circuit;

said first current-to-voltage converting circuit comprising a diode having one end connected to a second power supply and the other end connected to the terminal of said first current-to-voltage converting circuit;

each of said second and third current-to-voltage converting circuits comprises: a series circuit, which has one diode with one end thereof connected to the second power supply or a plurality of parallel-connected diodes with one ends thereof connected to the second power supply, and a resistor; and a separate resistor connected in parallel with the series circuit; said resistor and said separate resistor being connected in common to the terminal of each of said second and third current-to-voltage converting circuits; and a fourth current-to-voltage converting circuit including a resistor having one end connected to a second terminal of said fifth transistor and another end connected to the second power supply.

18. The circuit according to claim 17, wherein in said first and second reference current circuits, said second and third current-to-voltage converting circuits have different numbers of diodes from each other, and non-linearities of temperature characteristics of the diodes are made to have values that are differ from each other, thereby compensating for a temperature characteristic of output voltage.

19. The circuit according to claim 18, wherein the separate resistor in said second current-to-voltage converting circuit and the separate resistor in said third current-to-voltage converting circuit are made to have values that are different from each other, and output current values of said first and second reference current circuits are made different from each other.

20. The circuit according to claim 17, wherein at least one diode comprises a diode-connected bipolar transistor.

* * * * *